US012799606B2

(12) United States Patent
Lee et al.

(10) Patent No.: US 12,799,606 B2
(45) Date of Patent: Nov. 17, 2026

(54) AMMONIA ELECTROLYSIS SYSTEM AND CONTROL METHOD THEREOF

(71) Applicant: AESTECH CO., LTD., Daejeon (KR)

(72) Inventors: Chang Hyun Lee, Seongnam-si (KR); In Kee Park, Cheonan-si (KR)

(73) Assignee: AESTECH CO., LTD., Yuseong-gu (KR)

( * ) Notice: Subject to any disclaimer, the term of this patent is extended or adjusted under 35 U.S.C. 154(b) by 862 days.

(21) Appl. No.: 17/924,940

(22) PCT Filed: Sep. 20, 2022

(86) PCT No.: PCT/KR2022/014019

§ 371 (c)(1),
(2) Date: Nov. 11, 2022

(87) PCT Pub. No.: WO2023/054964

PCT Pub. Date: Apr. 6, 2023

(65) Prior Publication Data

US 2024/0218524 A1 Jul. 4, 2024

(30) Foreign Application Priority Data

Sep. 29, 2021 (KR) ..... 10-2021-0128773
Sep. 29, 2021 (KR) ..... 10-2021-0128777
Sep. 29, 2021 (KR) ..... 10-2021-0128779

(51) Int. Cl.
*C25B 1/02* (2006.01)
*C25B 3/09* (2021.01)
(Continued)

(52) U.S. Cl.
CPC ..... *C25B 1/02* (2013.01); *C25B 3/09* (2021.01); *C25B 3/25* (2021.01); *C25B 9/19* (2021.01);
(Continued)

(58) Field of Classification Search
CPC .... C25B 1/02; C25B 1/04; C25B 3/09; C25B 3/25; C25B 15/023
See application file for complete search history.

(56) References Cited

U.S. PATENT DOCUMENTS 8,308,917 B2 * 11/2012 Hinatsu ..... C25B 9/70 205/628
2009/0274591 A1 11/2009 Tulino et al.
(Continued)

FOREIGN PATENT DOCUMENTS

CN 108360011 A 8/2018
KR 10-2004-0057008 A 1/2004
(Continued)

OTHER PUBLICATIONS

Korean International Search Report issued in corresponding PCT Application (PCT/KR2022/014019) dated Dec. 29, 2022.
(Continued)

*Primary Examiner* — Brian W Cohen
(74) *Attorney, Agent, or Firm* — Morgan, Lewis & Bockius LLP

(57) ABSTRACT

According to one aspect of the present invention, an ammonia electrolysis system including a mixer to which ammonia is supplied; an electrolytic cell that is in communication with the mixer and is configured to receive the supplied ammonia and electrolyze the supplied ammonia into at least two different fluids; and a fluid separator that communicates with the electrolytic cell, receives the electrolyzed at least two different fluids, and separates the ammonia contained in the at least two different fluids, and a control method of the ammonia electrolysis system.

7 Claims, 13 Drawing Sheets

(51) Int. Cl.

| | |
|---|---|
| ***C25B 3/25*** | (2021.01) |
| ***C25B 9/19*** | (2021.01) |
| ***C25B 9/65*** | (2021.01) |
| ***C25B 15/023*** | (2021.01) |
| ***C25B 15/027*** | (2021.01) |
| ***C25B 15/08*** | (2006.01) |

(52) U.S. Cl.
CPC ..... *C25B 9/65* (2021.01); *C25B 15/023* (2021.01); *C25B 15/027* (2021.01); *C25B 15/083* (2021.01); *C25B 15/087* (2021.01)

(56) References Cited

U.S. PATENT DOCUMENTS

| | | | | |
|---|---|---|---|---|
| 2011/0086280 | A1* | 4/2011 | Roustaei ..... | B60L 58/30 204/230.2 |
| 2018/0251903 | A1* | 9/2018 | Xiang ..... | C25B 11/075 |

FOREIGN PATENT DOCUMENTS

| | | | |
|---|---|---|---|
| KR | 10-2008-0110901 | A | 12/2008 |
| KR | 10-1173456 | B1 | 8/2012 |
| KR | 10-2014-0044846 | A | 4/2014 |
| WO | 2008/061975 | A2 | 5/2008 |
| WO | 2010/094113 | A1 | 8/2010 |
| WO | 2012/167375 | A | 12/2012 |
| WO | 2018/116982 | A1 | 6/2018 |

OTHER PUBLICATIONS

Extended European Search Report issued on Jul. 14, 2025 in European Patent Application No. EP 22797622.2 (Note: CN108360011A and WO2018/116982A cited in this EESR have already been cited in a prior IDS.).

* cited by examiner

AMMONIA ELECTROLYSIS SYSTEM AND CONTROL METHOD THEREOF

TECHNICAL FIELD

The present invention relates to an electrolytic cell, a fluid separator, an ammonia electrolysis system, and a control method thereof, and more particularly, to an electrolytic cell, a fluid separator, an ammonia electrolysis system, and a control method therefor wherein ammonia can be decomposed into nitrogen and hydrogen by an electrochemical method, separating components and processes for separating the decomposed nitrogen and hydrogen are not required, and nitrogen oxide (NOx) is not generated during the ammonia decomposition.

BACKGROUND ART

Conventionally, electrical energy is produced by converting the energy generated by the combustion of fossil fuels. In general, fossil fuels contain carbon (C), nitrogen (N), and the like, and carbon oxides and nitrogen oxides are generated during the combustion of the fossil fuels.

As industrialization progresses, the carbon oxides and nitrogen oxides generated by the combustion of fossil fuels cause various problems such as environmental destruction and global warming. Therefore, research on technologies to utilize eco-friendly energy sources for sustainable growth is being actively conducted.

As a kind of such research, as an example, there is a fuel cell using hydrogen as an energy source. A fuel cell is a device that generates electrical energy by electrochemically reacting a fuel with an oxidizing agent. For example, the fuel cell may be configured to directly convert the chemical energy generated during a chemical reaction between hydrogen and oxygen into electrical energy.

In this case, only water ($H_2O$) is discharged as a by-product of the chemical reaction of hydrogen and oxygen. Therefore, from an environmentally friendly point of view, it is advantageous compared to the conventional internal combustion engine, and thus, the development of a vehicle using a fuel cell is actively progressing.

Currently commercialized fuel cells are operated by receiving hydrogen from an external source. However, it is difficult for drivers to secure hydrogen due to safety issues and low penetration rates of hydrogen refueling stations. This causes a decrease in the penetration rate of vehicles using fuel cells.

In order to overcome this, research on a method for directly supplying hydrogen to a fuel cell by providing a hydrogen compound instead of hydrogen to the vehicle and decomposing the hydrogen compound inside the vehicle is being conducted. As an example, there is a method of using ammonia ($NH_3$) as a hydrogen source.

However, when ammonia is decomposed, not only hydrogen but also nitrogen is generated. The generated nitrogen is highly likely to be synthesized into nitrogen oxide by reacting with oxygen in the fuel cell or external oxygen, which may be another cause of environmental pollution. In addition, ammonia inherently contains a high explosive potential depending on its phase.

Furthermore, not all of the supplied ammonia is decomposed into nitrogen and hydrogen, and some of the supplied ammonia may be remained as ammonia. If the residual ammonia leaks to the outside, it can cause fatal damage to the human body.

Therefore, in order to operate a fuel cell with the hydrogen prepared using ammonia, there must be a method for suppressing the generation of nitrogen oxides, preventing safety accidents such as explosions, and recovering the residual ammonia to prevent arbitrary leakage to the outside. In addition, the energy efficiency for hydrogen generation must be high, and the selectivity of hydrogen in the generated mixed fluid must be high.

Techniques for a method for generating hydrogen using ammonia have been introduced.

Korean Patent Registered Publication No. 10-1173456 discloses a micro-channel reactor for ammonia decomposition and ammonia decomposition method using the same. Specifically, the prior literature discloses a micro-channel reactor for ammonia decomposition and ammonia decomposition method using the same, which can catalytically decompose ammonia into nitrogen and hydrogen by stacking a plurality of micro-channel layers having micro-channels formed on the surface of a thin metal plate.

However, the micro-channel reactor for ammonia decomposition and the ammonia decomposition method disclosed in the prior literature provide only a method for reducing the size and improving thermal efficiency. That is, the prior literature does not provide a method for preventing accidents that may occur during ammonia decomposition.

Korean Patent Laid-Open Publication No. 10-2008-0110901 discloses an apparatus for decomposing liquid ammonia into gaseous nitrogen and hydrogen. Specifically, there is disclosed an apparatus for decomposing liquid ammonia into gaseous nitrogen and hydrogen, which can be provided to a vehicle by extracting hydrogen from liquid ammonia by using two reactors for performing thermal catalytic decomposition and a microwave resonator.

However, the apparatus for decomposing liquid ammonia into gaseous nitrogen and hydrogen disclosed in the prior literature only discloses a concept for providing hydrogen to a fuel cell using ammonia. That is, the prior literature also does not provide a method for solving the above-described problems, which may occur during ammonia decomposition.

Furthermore, the prior literatures are based on the premise that ammonia is thermally decomposed to produce nitrogen and hydrogen, and do not provide a method for decomposing ammonia by an electrochemical method.

DISCLOSURE

Technical Problem

An object of the present invention is to provide a mixer, an electrolytic cell, a fluid separator, an ammonia electrolysis system, and a control method thereof, which can solve the above problems.

First, an object of the present invention is to provide a mixer, an electrolytic cell, a fluid separator, an ammonia electrolysis system including the same, and a control method thereof, which have a structure capable of separating nitrogen and hydrogen from ammonia through an electrochemical method.

In addition, an object of the present invention is to provide a mixer, an electrolytic cell, a fluid separator, an ammonia electrolysis system including the same, and a control method thereof, which have a structure that does not require an additional process for separating the hydrogen and nitrogen decomposed from ammonia.

An object of the present invention is to provide a mixer, an electrolytic cell, a fluid separator, and an ammonia electrolysis system including the same, and a control method thereof, which have a structure with an improved degree of freedom in the selection of a phase of ammonia used as a source for separating hydrogen.

An object of the present invention is to provide a mixer, an electrolytic cell, a fluid separator, an ammonia electrolysis system including the same, and a control method thereof, which have a structure in which a process of separating nitrogen and hydrogen from ammonia can be continuously performed.

An object of the present invention is to provide a mixer, an electrolytic cell, a fluid separator, and an ammonia electrolysis system including the same, and a control method thereof, which have a structure capable of increasing the capacity or size by increasing the decomposition amount of ammonia and the amount of hydrogen generated accordingly.

An object of the present invention is to provide a mixer, an electrolytic cell, and a fluid separator, an ammonia electrolysis system including the same, and a control method thereof, which have a structure capable of suppressing the generation of nitrogen oxide (NOx) in the decomposition process of ammonia.

An object of the present invention is to provide a mixer, an electrolytic cell, a fluid separator, an ammonia electrolysis system including the same, and a control method thereof, which have a structure capable of improving the energy efficiency of a process for separating hydrogen from ammonia.

Technical Solution

In order to achieve the above object, according to one aspect of the present invention, it may be provided an ammonia electrolysis system, including a mixer to which ammonia is supplied: an electrolytic cell that is in communication with the mixer and is configured to receive the supplied ammonia and electrolyze the supplied ammonia into at least two different fluids; and a fluid separator that communicates with the electrolytic cell, receives the electrolyzed at least two different fluids, and separates the ammonia contained in the at least two different fluids.

An ammonia electrolysis system may be provided that the fluid separator is provided in plurality, and the at least two different fluids are respectively transferred to each of a plurality of the fluid separators.

An ammonia electrolysis system may be provided that the electrolytic cell electrolyzes the ammonia into hydrogen ($H_2$) and nitrogen ($N_2$), and the decomposed hydrogen and nitrogen are respectively introduced into each of the plurality of fluid separators.

An ammonia electrolysis system may be provided that the electrolytic cell includes an anode and a cathode placed apart from each other and a membrane member disposed between the anode and the cathode to space the anode and the cathode apart.

An ammonia electrolysis system may be provided that the mixer includes a mixer body that is formed with a space accommodating the ammonia therein: an additive supplier that communicates the space and an outside, and through which an additive to be mixed with the ammonia is introduced: and a stirrer that is rotatably accommodated in the space of the mixer body and mixes the supplied ammonia with the introduced additive.

An ammonia electrolysis system may be provided, including a controller that is electrically connected to the electrolytic cell and is configured to supply power for the electrolytic cell to electrolyze the ammonia into the at least two different fluids.

An ammonia electrolysis system may be provided that the mixer includes a mixing temperature controller that is configured to control temperature of the ammonia accommodated in the mixer, and the electrolytic cell includes a cell temperature controller that is configured to control temperature of an inner space of the electrolytic cell.

An ammonia electrolysis system may be provided, including a pressure sensor that senses pressure of the mixer to which the ammonia is supplied and pressure of the electrolytic cell; and a controller that is configured to communicate the mixer and the electrolytic cell so that the supplied ammonia flows to the electrolytic cell when the sensed pressure of the mixer and the sensed pressure of the electrolytic cell are the same.

An ammonia electrolysis system may be provided that the ammonia is in a liquid phase or a gas phase.

According to another aspect of the present invention, it may be provided a method of controlling an ammonia electrolysis system, including the steps of (a) controlling temperature of ammonia accommodated in a mixer: (b) introducing the ammonia into an electrolytic cell: (c) supplying power to the electrolytic cell to electrolyze the ammonia into at least two different fluids: (d) introducing the decomposed at least two different fluids into a fluid separator; and (e) separating the ammonia contained in the at least two different fluids introduced into the fluid separator.

A method of controlling an ammonia electrolysis system may be provided that the step (a) includes the steps of (a1) supplying the ammonia into the mixer: (a2) controlling temperature of the mixer accommodating the ammonia by a mixing temperature controller: and (a3) controlling temperature of the electrolytic cell by a cell temperature controller.

A method of controlling an ammonia electrolysis system may be provided that the step (a) includes the steps of (a4) introducing an additive to the mixer; and (a5) operating a stirrer provided in the mixer to mix the ammonia and the additive.

A method of controlling an ammonia electrolysis system may be provided that the step (b) includes the steps of (b1) sensing pressure of the mixer and pressure of the electrolytic cell by a pressure sensor: (b2) comparing the sensed pressure of the mixer with the sensed pressure of the electrolytic cell by a controller; and (b3) opening a passage unit communicating the mixer and the electrolytic cell by the controller when the pressure of the electrolytic cell is the same as the pressure of the mixer.

A method of controlling an ammonia electrolysis system may be provided that the step (c) includes the steps of (c1) applying power to the electrolytic cell by a controller: (c2) generating a potential difference between an anode and cathode of the electrolytic cell by the applied power: and (c3) generating reduction and oxidation reactions in the cathode and anode of the electrolytic cell, respectively, to decompose the ammonia into the at least two different fluids.

A method of controlling an ammonia electrolysis system may be provided that the step (d) includes the steps of (d1) sensing pressure of the electrolytic cell by a pressure sensor: (d2) comparing the pressure of the electrolytic cell sensed by a controller with the pressure of the electrolytic cell before the power is supplied to the electrolytic cell: and (d3) opening a passage unit communicating the electrolytic cell and the fluid separator by the controller when a difference between the sensed pressure of the electrolytic cell and the pressure of the electrolytic cell before the power is supplied is greater than or equal to a preset reference difference, wherein the fluid separator is provided in plurality, and the decomposed at least two different fluids flow to different fluid separators among a plurality of the fluid separators.

A method of controlling an ammonia electrolysis system may be provided that the step (e) includes the steps of (e1) introducing the decomposed at least two different fluids into different fluid separators among a plurality of the fluid separators: (e2) separating the ammonia mixed with the different fluids introduced into the different fluid separators: and (e3) introducing the different fluids from which the ammonia is separated into a plurality of trap members respectively connected to the plurality of the fluid separators to further separate the ammonia remaining in the different fluids.

A method of controlling an ammonia electrolysis system may be provided, including the step (f) of further supplying the ammonia from the mixer to the electrolytic cell after the step (e).

A method of controlling an ammonia electrolysis system may be provided that the step (f) includes the steps of (f1) sensing pressure of the mixer and pressure of the electrolytic cell by a pressure sensor: (f2) comparing the pressure of the mixer sensed by a controller with the pressure of the electrolytic cell: and (f3) opening a passage unit communicating the mixer and the electrolytic cell by the controller when the pressure of the electrolytic cell is less than or equal to a preset first reference pressure.

A method of controlling an ammonia electrolysis system may be provided, including the step (g) of controlling operation of the mixer and operation of the electrolytic cell by a controller according to a state of the mixer and a state of the electrolytic cell, after the step (e).

A method of controlling an ammonia electrolysis system may be provided that the step (g) includes the steps of (g1) sensing voltage of the electrolytic cell, pressure of the electrolytic cell, and level of the ammonia supplied to the mixer, by a sensor unit; (g21) comparing the sensed voltage of the electrolytic cell with a preset reference voltage by the controller: (g22) blocking the power applied to the electrolytic cell by the controller when the sensed voltage of the electrolytic cell is different from the reference voltage: (g31) comparing the sensed pressure of the electrolytic cell with a preset second reference pressure by the controller: (g32) closing a passage unit communicating the electrolytic cell and the mixer by the controller when the sensed pressure of the electrolytic cell is different from the second reference pressure: (g41) comparing the sensed level of the ammonia with a preset reference level by the controller: and (g42) closing the passage unit communicating the electrolytic cell and the mixer by the controller when the sensed level of the ammonia is smaller than the reference level.

According to one aspect of the present invention, it may be provided an electrolytic cell including an electrolytic cell housing that is formed with a space for accommodating the ammonia transferred from an external mixer; an anode and cathode accommodated in the space of the electrolytic cell housing: and a membrane member that is positioned between the anode and the cathode to space the anode and the cathode apart, wherein the anode and the cathode may be configured to be electrically connected to an external controller, respectively, and electrolyze the accommodated ammonia into at least two different fluids by using a current transmitted from the controller.

An electrolytic cell may be provided that the membrane member is formed of an ionomer material that blocks the ions generated from any one of the anode and the cathode from moving to the other one of the anode and the cathode.

An electrolytic cell may be provided that the membrane member is formed of a ceramic material that allows only molecules of a predetermined size or less to pass therethrough.

An electrolytic cell may be provided that the electrolytic cell housing includes a first cell housing that is formed with a space accommodating any one of the anode and the cathode: and a second cell housing that is formed with a space accommodating the other one of the anode and the cathode and being physically separated from the space of the first cell housing, and is coupled to the first cell housing.

An electrolytic cell may be provided that the first cell housing and the second cell housing communicate with the external mixer through a separate flow path, respectively.

An electrolytic cell may be provided that the electrolytic cell housing communicates with an external fluid separator receiving the at least two different fluids.

An electrolytic cell may be provided that the external fluid separator is provided in plurality, and the electrolytic cell housing includes a first cell housing that is formed with a space accommodating any one of the anode and the cathode and communicating with any one of a plurality of the external fluid separators; and a second cell housing that is formed with a space accommodating the other one of the anode and the cathode and communicating with the other one of the plurality of external fluid separators.

An electrolytic cell may be provided, including a gasket member that is disposed between the anode and the cathode and is formed to surround the outer periphery of the membrane member.

According to another aspect of the present invention, it may be provided an ammonia electrolysis system including a mixer to which ammonia is supplied: an electrolytic cell that is in communication with the mixer, is configured to receive the supplied ammonia and electrolyze the received ammonia into at least two different fluids; and a fluid separator that communicates with the electrolytic cell and receives the electrolyzed at least two different fluids to separate the ammonia contained in the at least two different fluids: the electrolytic cell includes an electrolytic cell housing that communicates with the mixer and is formed with a space to receive and accommodate the ammonia: an anode and cathode that are accommodated in the space of the electrolytic cell housing and are electrically connected to an external controller to electrolyze the accommodated ammonia: and a membrane member that is positioned between the anode and the cathode to space the anode and the cathode apart; the membrane member blocks the ions generated from one of the anode and the cathode from moving to the other one of the anode and the cathode.

According to one aspect of the present invention, it may be provided a fluid separator, including a separator body that receives at least two different fluids generated by electrolysis of ammonia in an external electrolytic cell, and separates the ammonia contained in the at least two different fluids; and a trap member that communicates with the separator body to receive the at least two different fluids from which the ammonia is separated: the separator body is provided in plurality, and the plurality of the separator bodies is configured to receive different fluids among the at least two different fluids.

A fluid separation may be provided that in the fluid separator, the external electrolytic cell includes a plurality of spaces that accommodates the at least two different fluids, respectively, and is separated from each other, and the plurality of the separator bodies may be configured to communicate with the plurality of the spaces provided in the external electrolytic cell, respectively, and to receive the generated at least two different fluids, respectively.

A fluid separation may be provided, including a separation temperature controller that is configured to be connected to the separator body and to control the temperatures of the separator body and at least two different fluids accommodated in the separator body.

A fluid separation may be provided that the separator body is provided in plurality, and a plurality of the separator bodies receives and accommodates the generated at least two different fluids, respectively, and the separation temperature controller is provided in plurality, and a plurality of the separation temperature controllers is connected to the plurality of separator bodies, respectively.

A fluid separation may be provided that the trap member is configured to further separate the residual ammonia from the received at least two different fluids.

A fluid separation may be provided that the trap member is provided in plurality, so that any one of a plurality of the trap members communicates with the separator body, and the other one of the plurality of trap members communicates with the one trap member and the outside.

A fluid separation may be provided that the generated at least two different fluids pass sequentially through the separator body and the plurality of trap members to be separated from the residual ammonia.

According to another aspect of the present invention, it may be provided an ammonia electrolysis system, including a mixer to which ammonia is supplied: an electrolytic cell that is configured to be in communication with the mixer and to receive the supplied ammonia and electrolyze the received ammonia into at least two different fluids; and a fluid separator that communicates with the electrolytic cell and receives the electrolyzed at least two different fluids to separate the ammonia contained in the at least two different fluids: the fluid separator includes a separator body that communicates with the electrolytic cell and receives the at least two different fluids to separate the ammonia mixed with the fluids; and a trap member that communicates with the separator body and receives the at least two different fluids from which the ammonia is separated and further separates the residual ammonia; the separator body is provided in plurality, and a plurality of the separator bodies receives different fluids from among the at least two different fluids: the trap member is provided in plurality: the at least two different fluids passing through the separator body sequentially pass through the plurality of trap members and the residual ammonia is separated.

Advantageous Effect

According to an electrolytic cell, a fluid separator, an ammonia electrolysis system, and a control method thereof according to an embodiment of the present invention, the following effects can be achieved.

First, the ammonia supplied from a bombe is introduced into an electrolytic cell. The electrolytic cell is electrically connected to a controller, and receives a current from the controller. The electrolytic cell electrochemically decomposes the introduced ammonia by using the current applied from the controller.

Thus, ammonia can be decomposed into nitrogen and hydrogen without a separate chemical or physical process and a means for carrying out the same.

In addition, an electrolytic cell is provided with an anode and a cathode. The current applied from the controller is passed through the anode and the cathode. The ammonia flowing into the electrolytic cell is separated into nitrogen and hydrogen by an electrochemical reaction that proceeds at the anode and the cathode, respectively.

In each space of the electrolytic cell accommodating the anode and the cathode, the nitrogen and gas generated in the anode and cathode do not mix with each other by a membrane member.

Each space of the electrolytic cell accommodating the anode and the cathode communicates with different fluid separators through separate discharge passages. Accordingly, the nitrogen and hydrogen generated in each space may flow to the different fluid separators through the separate discharge passages.

Therefore, the nitrogen and hydrogen generated by electrolysis in the electrolytic cell can be discharged to the outside without being mixed, so that an additional process and equipment for separating nitrogen and hydrogen are not required.

In addition, ammonia in a liquid or gas phase may be accommodated in the bombe. In a mixer receiving ammonia from the bombe, its temperature, pressure, and level may be controlled by the controller.

The controller is configured to perform temperature control or pressure control for changing the ammonia supplied to the mixer into a liquid phase or a gas phase. The controller is configured to control the temperatures and pressures of the electrolytic cell, fluid separator, and utility unit, as well as the temperature and pressure of the mixer.

Therefore, no matter what phase ammonia used as a raw material for electrolysis of hydrogen and nitrogen is provided, the ammonia can be introduced into the electrolytic cell after being changed to a more favorable phase for the operation of the ammonia electrolysis system. As a result, the selectivity of the phase of ammonia can be improved.

In addition, the nitrogen and hydrogen electrolyzed from ammonia in the electrolytic cell are passed through a fluid separator and then transferred to a subsequent process. The residual ammonia separated from nitrogen and hydrogen in the fluid separator is recovered to the bombe and fed back to the mixer.

The controller calculates the control information for controlling the operation of each component of the ammonia electrolysis system by using the information sensed by each sensor unit provided in the ammonia electrolysis system. When the ammonia electrolysis system is normally operated, the controller controls each component so that the recovered ammonia and the additionally supplied ammonia flow back to the mixer.

Accordingly, the supply of ammonia, the electrolysis of ammonia, the discharge of decomposed nitrogen and hydrogen, and the recovery of the separated residual ammonia can be performed continuously.

In addition, a plurality of electrolytic cells may be provided and stacked. The plurality of electrolytic cells is in communication with the mixer for supplying ammonia and the fluid separator for treating the electrolyzed fluid, respectively. In this case, the plurality of electrolytic cells may be in communication with the mixer and the fluid separator through separate passages, respectively. That is, the operation of any one or more of the plurality of electrolytic cells does not affect the operation of the other one or more electrolytic cells.

Therefore, the electrolysis capacity of ammonia can be controlled according to the environment in which the ammonia electrolysis system is provided. As a result, the amount of hydrogen generated by electrolysis of ammonia by the ammonia electrolysis system can also be controlled as needed, making it possible to increase or decrease the capacity of the system.

In addition, as described above, the nitrogen and hydrogen generated by electrolysis of ammonia in the electrolytic cell may be discharged to the outside of the electrolytic cell through a separate passage without a separate separation process. Accordingly, nitrogen and hydrogen may be respectively introduced into the plurality of fluid separators in communication with the electrolytic cell. In particular, the fluid separator into which nitrogen is introduced may be in communication with an external storage space or a device for a denitrification process, so that nitrogen may be stored separately or discharged to the outside after undergoing a denitrification process.

Therefore, even if the ammonia electrolysis system is operated and ammonia is electrolyzed, the generated nitrogen is not randomly discharged into the atmosphere. As a result, the generation of nitrogen oxide (NOx) generated by the reaction of nitrogen generated as a result of electrolysis with oxygen can be minimized.

In addition, as described above, ammonia may be decomposed into nitrogen and hydrogen by an electrochemical method rather than a physical or chemical method. In order to electrolyze ammonia, the controller electrically connected to the electrolytic cell may be configured to apply a small amount of current.

Accordingly, the amount of energy required for electrolysis of ammonia into nitrogen and hydrogen can be minimized. As a result, the economic cost required for the provision and operation of the ammonia electrolysis system can be reduced.

MODE FOR INVENTION

Figure 1:
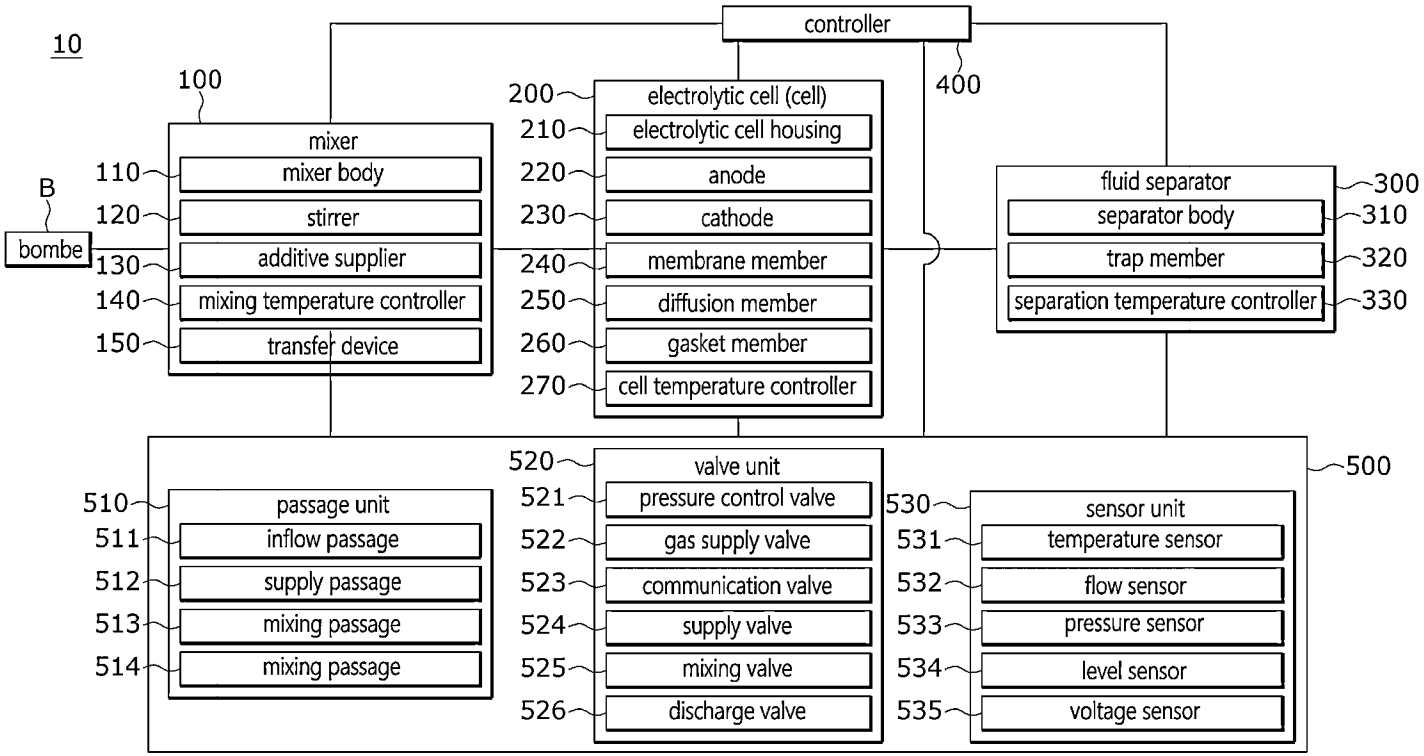
FIG. 1 is a block diagram illustrating the configuration of an ammonia electrolysis system according to an embodiment of the present invention.

Hereinafter, an ammonia electrolysis system 10 and a control method thereof according to an embodiment of the present invention will be described in detail with reference to the accompanying drawings.

In the following description, in order to clarify the characteristics of the present invention, descriptions of some components may be omitted.

1. Definition of Terms

As used in the following description, the term "fluid" means any material in a liquid or gas phase. The ammonia used as an energy source of an ammonia electrolysis system 10 according to an embodiment of the present invention may be provided in a liquid or gas phase.

The term "electrolysis" used in the following description means a process of decomposing a material using electrical energy. In one embodiment, electrolysis may be utilized to decompose ammonia into nitrogen and hydrogen.

As used in the following description, the term "communication" means that one or more members are connected to one or more other members in fluid communication.

As used in the following description, the term "energizable connection" means that one or more members are connected to one or more other members to be capable of transmitting an electrical signal or current. In one embodiment, the energizable connection may be established in a wireless or wired manner.

2. Ammonia Electrolysis System 10 According to an Embodiment

The ammonia electrolysis system 10 according to an embodiment of the present invention may decompose ammonia into nitrogen and hydrogen using an electrochemical method. The decomposed nitrogen and hydrogen are physically separated from each other without a separate separation process and are not mixed, and may be provided in a fuel cell or a separate storage space, respectively. In addition, the nitrogen generated as a result of the decomposition of ammonia is not randomly discharged to the outside, so that the generation of nitrogen oxide can be suppressed.

Hereinafter, the configuration of the ammonia electrolysis system 10 according to an embodiment of the present invention will be described in detail with reference to FIGS. 1 to 6.

In the illustrated embodiment, the ammonia electrolysis system 10 includes a mixer 100, an electrolytic cell 200, a fluid separator 300, a controller 400, and a utility unit 500.

(1) Mixer 100

The mixer 100 receives ammonia from an external bombe B. In this case, the ammonia received by the mixer 100 may be provided as pure ammonia, not in a state of being dissolved in a solvent such as water. The ammonia may also be provided in a liquid or gas phase.

The mixer 100 may control the received ammonia to an appropriate temperature for the electrolytic reaction. In one embodiment, the mixer 100 may be controlled to a temperature sufficient to liquefy the received ammonia to be maintained in a liquid phase.

As is known, a melting point of ammonia, i.e., a temperature at which ammonia exists in a liquid phase, can be changed according to pressure. Specifically, the temperature at which ammonia exists in a liquid phase tends to increase with increasing pressure.

However, in order to prevent the occurrence of a safety accident during the operation of the ammonia electrolysis system 10, it is not preferable that ammonia is formed to have an excessive pressure.

Therefore, the mixer 100 maintains the received ammonia in a cooled state by a predetermined temperature, so that the ammonia can be maintained in a liquid phase without being excessively compressed. In one embodiment, the mixer 100 may be configured to maintain the temperature of the ammonia in the temperature range of −80° ° C. to 135° C. As a heat source for cooling ammonia, the mixer 100 may be provided with a mixing temperature controller 140.

The mixer 100 communicates with the bombe B. Specifically, the mixer 100 communicates with the bomber B by an inflow passage 511 of a passage unit 510 provided in the utility unit 500. The ammonia stored in the bombe B may flow into the mixer 100 through the inflow passage 511.

The mixer 100 is in communication with the electrolytic cell 200. Specifically, the mixer 100 communicates with the electrolytic cell 200 by a supply passage 512 of the passage unit 510 provided in the utility unit 500. The temperature is controlled and the ammonia mixed with an additive may flow into the electrolytic cell 200.

The mixer 100 is electrically connected to the controller 400. The operation of the mixer 100 may be controlled by an electrical signal by the controller 400 or by an operator. That is, each component of the mixer 100 to be described below may be controlled by the controller 400 or an operator.

Furthermore, the communication between the mixer 100 and the bomber B or between the mixer 100 and the electrolytic cell 200 may also be controlled by the controller 400 or an operator. Therefore, the ammonia is not randomly introduced into the inside of the mixer 100 or flows out from the inside of the mixer 100 to the outside.

In the illustrated embodiment, the mixer 100 includes a mixer body 110, a stirrer 120, an additive supplier 130, a mixing temperature controller 140, and a transfer device 150.

The mixer body 110 forms the outer shape of the mixer 100. A space is formed inside the mixer body 110. The ammonia transferred from the bomber (B) may be accommodated in the space.

The space of the mixer body 110 communicates with the outside. Specifically, the mixer body 110 communicates with the bombe B and the electrolytic cell 200. As described above, the space of the mixer body 110 communicates with the outside by the passage unit 510 provided in the utility unit 500.

The stirrer 120 is rotatably provided inside the mixer body 110.

The stirrer 120 mixes the ammonia accommodated in the inner space of the mixer body 110 and the additive supplied through the additive supplier 130. The stirrer 120 is rotatably coupled to the mixer body 110, and a foil may be formed at one end of the mixer body 110 in the extension direction thereof. The foil of the stirrer 120 may be disposed to be submerged in the ammonia accommodated in the space of the mixer body 110.

In one example, the other end in the extension direction of the stirrer 120 is partially exposed to the outside of the mixer body 110, but the stirrer 120 may be coupled to the mixer body 110 in any form capable of rotating the ammonia and additives accommodated in the mixer body 110.

The additive supplier 130 is put into the space of the mixer body 110, and mixed with the ammonia accommodated in the space. The additive supplier 130 may communicate with the space of the mixer body 110 such that the additive supplier 130 is opened and closed to the outside.

In other words, the additive supplier 130 is configured to be opened or closed, and may be opened when an additive is to be added, and may be closed when the input of the additive is completed. As described above, the operation of the additive supplier 130 may be performed by the controller 400 or an operator.

In order to open and close the additive supplier 130, a cap member (not indicated by a reference numeral) may be provided.

The additive introduced through the additive supplier 130 may be made of any material capable of improving the efficiency of the electrolytic reaction of ammonia. In one embodiment, the additive input through the additive supplier 130 may be composed of an ionic additive. The ionic additive serves to promote the ionization of ammonia for a rapid electrolytic reaction, contributes to the improvement of the electrolytic reaction rate, and consequently can improve the electrolytic reaction efficiency due to the reduction of overvoltage. However, when the ionic additive is not added, the reaction rate of ammonia electrolysis may decrease, but the electrolytic reaction proceeds.

In the above embodiment, the additive may be provided with $LiNH_2$, $NaNH_2$, $KNH_2$, $KPF_6$, $NH_4PF_6$, $KNH_2$ $KHCO_3$, $K_2CO_3$, KOH, KCl, $KClO_4$, $K_2SiO_3$, $Na_2SO_4$, $NaNO_3$, NaCl, NaF, $NaClO_4$, $CaCl_2$), guanidinium cation, $H^+$ cation, alkali metal cation, ammonium cation, alkylammonium cation, halide ion, alkyl amine, borate, carbonate, guanidinium derivative, nitrite, nitrate, phosphate, polyphosphate, perchlorate, silicate, sulfate, tetraalkyl ammonium, or a material formed by mixing any one or more thereof.

The mixing temperature controller 140 constantly maintains the temperature of the ammonia accommodated in the space of the mixer body 110 or the temperature of additive-mixed ammonia, thereby controlling the temperature so that the ionic additive is not precipitated. The mixing temperature controller 140 is connected to the mixer body 110 and is configured to transmit or receive thermal energy.

In one embodiment, the mixing temperature controller 140 may be connected not only to the mixer body 110, but also to the passage unit 510 connecting the mixer 100 and the bombe B or the mixer 100 and the electrolytic cell 200. In the above embodiment, the mixing temperature controller 140 may constantly maintain the temperature of the passage unit 510 through which ammonia or additive-mixed ammonia flows, as well as the temperature of the mixer body 110.

In one embodiment, the mixing temperature controller 140 may maintain the temperature of the mixer body 110 and ammonia or additive-mixed ammonia contained in the mixer body within a range of −80° C. to 135° C., and preferably within a range of −50° ° C. to 120° C. for the electrolytic reaction. When the temperature is less than −80° C., it may not be economical because insulation for maintaining the temperature condition in the mixer is difficult, and the solubility of the ionic additive is lowered due to the low temperature and precipitated, so the electrolytic reactivity may be lowered. Conversely, when the temperature exceeds 135° C., it may not be economical because a separate heat source must be provided to maintain the temperature of the mixer, and performance is degraded due to deterioration of the membrane member disposed between the cathode and the anode, so that it may cause a problem of lowering durability, and the electrolytic reactivity may be lowered.

The mixing temperature controller 140 may be provided in any form capable of maintaining a constant temperature of itself or of other members. In one embodiment, the mixing temperature controller 140 may be provided in the form of a chiller.

The transfer device 150 provides a transfer force for the ammonia or additive-mixed ammonia contained in the space of the mixer body 110 to flow toward the electrolytic cell 200. The transfer device 150 may be provided in the supply passage 512 of the passage unit 510 provided in the utility unit 500 to provide a transfer force to the ammonia flowing therein.

As will be described later, the controller 400 may control the mixer 100 and the electrolytic cell 200 such that the mixer 100 and the electrolytic cell 200 are communicated with each other when the internal pressures of the mixer 100 and electrolytic cell 200 are the same. As is known, when the pressures in the two different spaces are the same, the fluid therein does not flow from one space to the other space.

The pressure in the fluid separator in the electrolysis system is maintained by a pressure sensor installed throughout the electrolysis system within a range of 0.06 bar to 115 bar. When the pressure is less than 0.06 bar, liquefaction is not effective because the internal pressure of the fluid separator 300 is low. Conversely, when the pressure exceeds 115 bar, it is not economical because a separate compressor is required for pressurization in the fluid separator 300.

When a pressure change occurs due to the hydrogen gas and nitrogen gas generated through the electrochemical reaction of ammonia in the electrolytic cell 200, the valve unit 520 is controlled to discharge the gas generated from the fluid separator 300 so that the pressure of the electrolysis system can be maintained.

The transfer device 150 provides a transfer force for the ammonia to flow between the electrolytic cell 200 and the mixer 100, which are maintained at the same pressure.

The transfer device 150 may be provided in any form capable of providing a transfer force to the fluid. In one embodiment, the transfer device 150 may be provided in the form of a pump.

(2) Electrolytic Cell 200

The electrolytic cell 200 substantially serves to electrolyze the ammonia supplied to the ammonia electrolysis system 10 into at least two fluids. In one embodiment, the electrolytic cell 200 may electrolyze the supplied ammonia into nitrogen and hydrogen.

The electrolytic cell 200 is communicated with the mixer 100, the temperature is controlled in the mixer 100, and the additive-mixed ammonia may be transferred to the electrolytic cell 200. The electrolytic cell 200 and the mixer 100 may communicate with each other by the supply passage 512 of the passage unit 510 provided in the utility unit 500.

The electrolytic cell 200 is in communication with the fluid separator 300, and at least two fluids separated from the electrolytic cell 200, that is, generated by electrolysis of ammonia, may flow to different fluid separators 300, respectively. The electrolytic cell 200 and the fluid separator 300 may communicate with each other by a mixing passage 513 of the passage unit 510 provided in the utility part 500.

The electrolytic cell 200 may be electrically connected to the controller 400 and may receive a current for electrolyzing the supplied ammonia. In addition, the operation of the electrolytic cell 200 may be controlled according to the control signal transmitted from the controller 400.

The electrolytic cell 200 may be provided in plurality. A plurality of the electrolytic cells 200 may be stacked on each other to electrolyze ammonia into at least two fluids, respectively.

Figure 2:
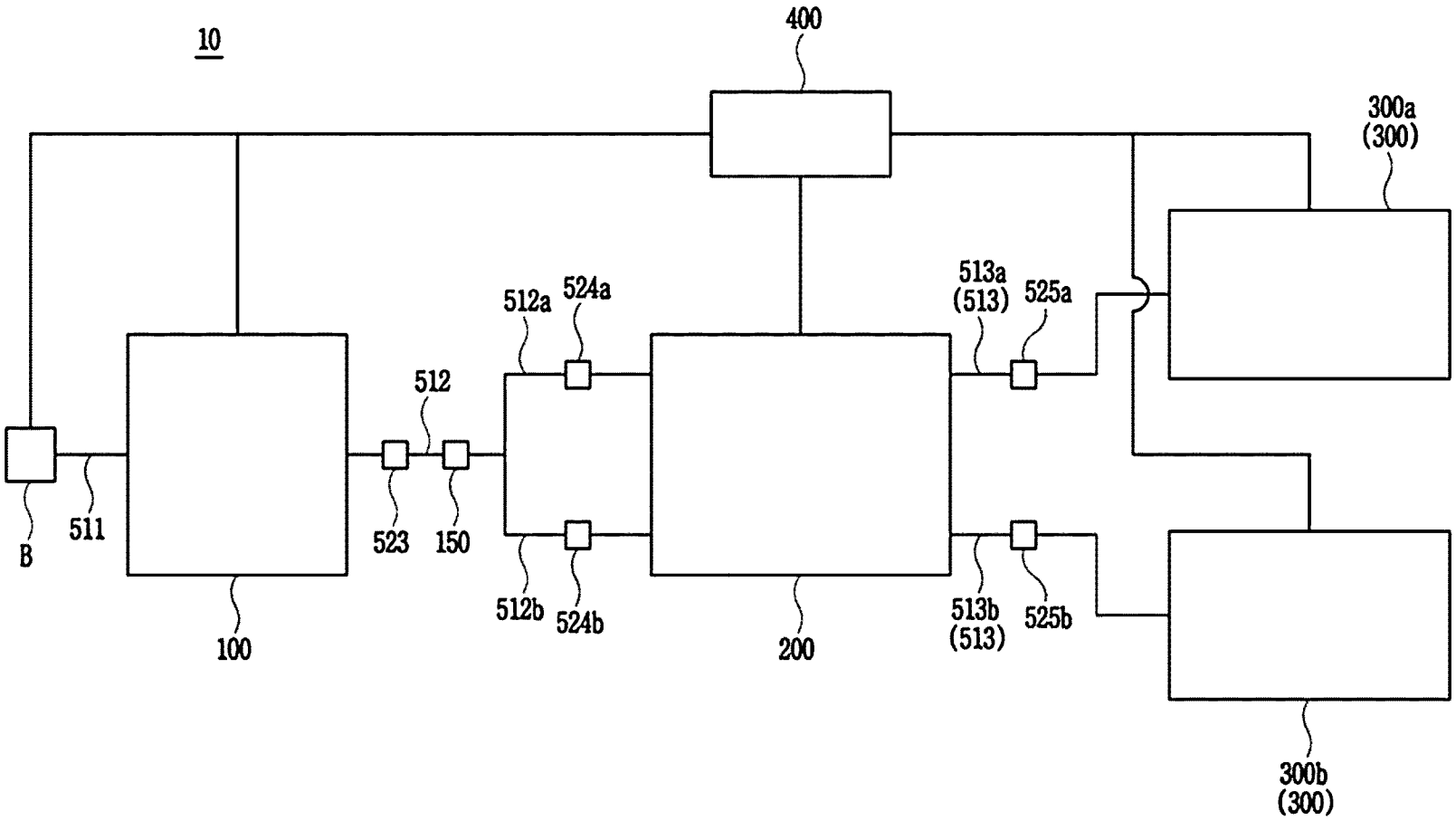
FIG. 2 is a block diagram illustrating the configuration of an ammonia electrolysis system according to an embodiment of the present invention.
Figure 3:
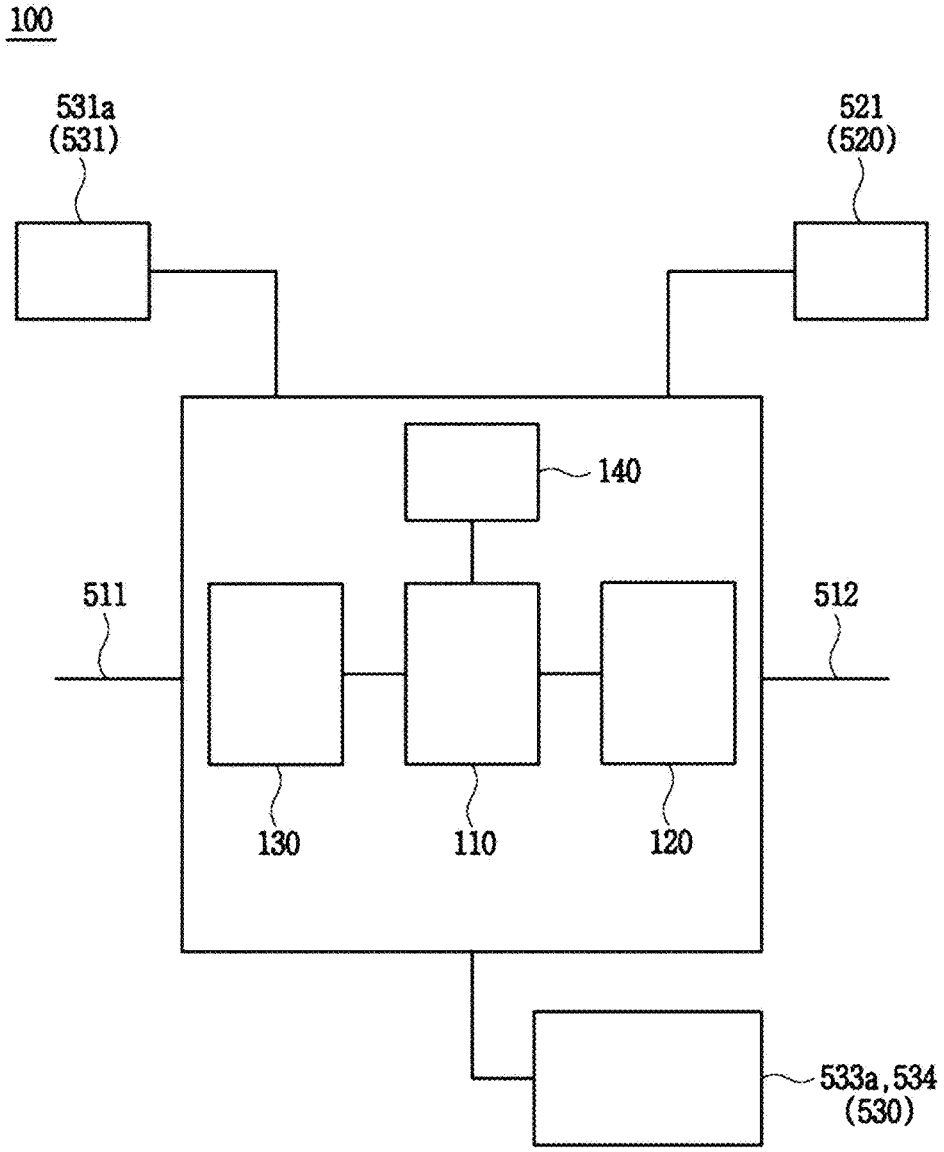
FIG. 3 is a block diagram illustrating the configuration of a mixer provided in the ammonia electrolysis system of FIG. 1.
Figure 4:
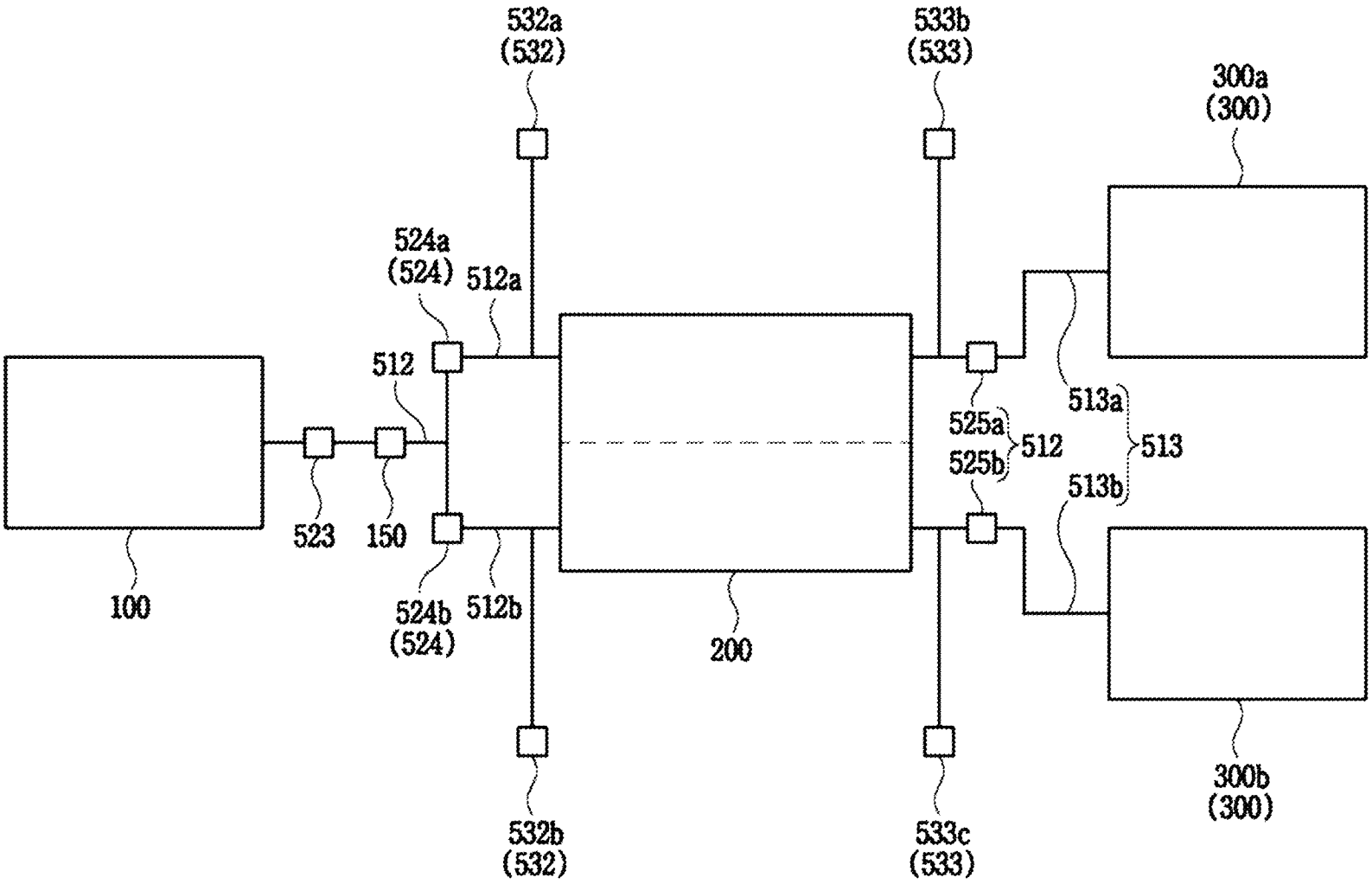
FIG. 4 is a conceptual diagram illustrating a connection block between a mixer and electrolytic cell provided in the ammonia electrolysis system of FIG. 1.

In the embodiment illustrated in FIG. 2, although it is illustrated that a single electrolytic cell 200 is provided, a plurality of the electrolytic cells 200 may be provided and arranged side by side in the width direction thereof.

It will be understood that in the above embodiment, the supply passage 512 for supplying ammonia to each electrolytic cell 200 and the mixing passage 513 for discharging at least two electrolyzed fluids may be additionally provided for each electrolytic cell 200.

In addition, in the above embodiment, the electrolysis capacity of ammonia may be changed according to the number of the provided electrolytic cells 200. Therefore, according to the above embodiment, the amount of hydrogen or nitrogen generated by the ammonia electrolysis system 10 may be controlled, so that it can be applied to various systems.

In the illustrated embodiment, the electrolytic cell 200 includes an electrolytic cell housing 210, an anode 220, a cathode 230, a membrane member 240, a diffusion member 250, a gasket member 260, and a cell temperature controller 270.

The electrolytic cell housing 210 forms the outer shape of the electrolytic cell 200. A space is formed inside the electrolytic cell housing 210 to accommodate the ammonia transferred from the mixer 100. In addition, the space of the electrolytic cell housing 210 may accommodate at least two fluids generated by electrolysis of the transferred ammonia.

The space of the electrolytic cell housing 210 communicates with the outside. Specifically, the space of the electrolytic cell housing 210 may be communicated with the inner space of the mixer 100 by the supply passage 512 of the passage unit 510. In addition, the space of the electrolytic cell housing 210 may communicate with the fluid separator 300 by the mixing passage 513 of the passage unit 510.

In the illustrated embodiment, the electrolytic cell housing 210 is formed in a disk shape whose cross section is longer in the vertical direction than the length in the left and right direction. The shape of the electrolytic cell housing 210 may be provided in any form capable of generating at least two fluids by electrolyzing the ammonia supplied to the inner space of the electrolytic cell housing 210.

However, as described above, in order for the electrolytic cell 200 to be provided in plurality and stacked in the width direction (left and right direction in the illustrated embodiment), the shape of the electrolytic cell housing 210 is preferably formed so that the length in the left and right direction is shorter than the length in the vertical direction.

Figure 5:
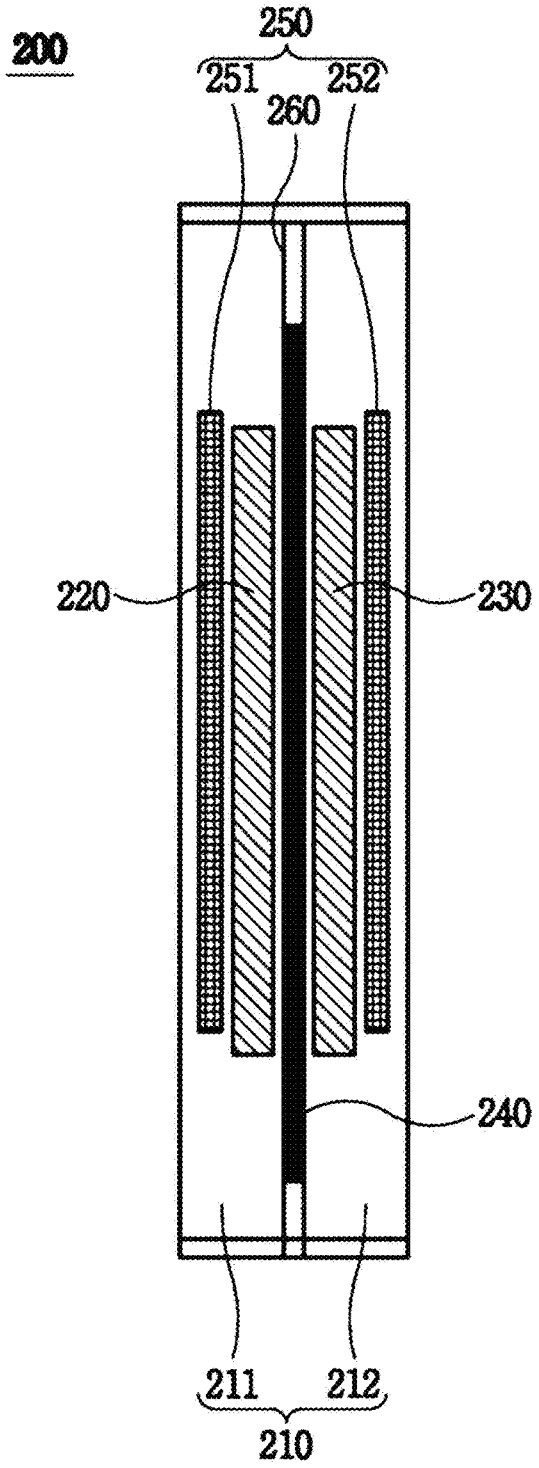
FIG. 5 is a conceptual diagram illustrating the configuration of an electrolytic cell provided in the ammonia electrolysis system of FIG. 1.

In the above embodiment, it will be understood that the shape of the electrolytic cell 200 of FIG. 5 is illustrated in a diametrical cross section.

In the illustrated embodiment, the electrolytic cell housing 210 includes a first cell housing 211 and a second cell housing 212. The first cell housing 211 and the second cell housing 212 are formed to have shapes corresponding to each other, and may be coupled to each other while forming a space therebetween.

In the illustrated embodiment, the first cell housing 211 and the second cell housing 212 form a space on a radially inner side, and the radially outer side thereof may be contact-coupled to be sealed with each other. Accordingly, the ammonia introduced into the inner space of the electrolytic cell housing 210 and at least two fluids generated by electrolysis of the introduced ammonia are not arbitrarily discharged to the outside.

To this end, the gasket member 260 for sealed coupling may be provided between the first cell housing 211 and the second cell housing 212.

A space is formed in each of the first cell housing 211 and the second cell housing 212. The anode 220 and the cathode 230 may be accommodated in the space of the first cell housing 211 and the space of the second cell housing 212, respectively.

As illustrated in FIG. 5, the anode 220 is accommodated in the inner space of the first cell housing 211 and the cathode 230 is accommodated in the inner space of the second cell housing 212, respectively. The accommodated anode 220 and cathode 230 are spaced apart by the membrane member 240.

The anode 220, the cathode 230, the membrane member 240, and the diffusion member 250 are accommodated in the inner space of the electrolytic cell housing 210.

The anode 220 and the cathode 230 generate at least two fluids by electrolyzing the ammonia supplied to the inner space of the electrolytic cell housing 210 by using the current applied from the controller 400. In one embodiment, ammonia may be introduced into the inner space of the electrolytic cell housing 210. In addition, nitrogen and hydrogen may be generated by the anode 220 and the cathode 230.

As illustrated in FIG. 5, the anode 220 and the cathode 230 may be spaced apart from each other by the membrane member 240. Accordingly, in a state accommodated in the electrolytic cell housing 210, ammonia may be supplied to at least one of the anode 220 and the cathode 230.

Therefore, according to the amount of hydrogen or nitrogen required, the supply of ammonia may be controlled so that the operation of the ammonia electrolysis system 10 may be more efficient.

The anode 220 and the cathode 230 may be provided in any form in which the current applied from the controller 400 can be energized and electrolyze the introduced ammonia. In an embodiment, the anode 220 and the cathode 230 may be formed of a conductive material.

The anode 220 and the cathode 230 are electrically connected to each other. The connection may be formed by a conducting wire member (not shown) or the like.

For example, the anode 220 may be formed from any one material of platinum, gold, silver, palladium, iridium, rhodium, ruthenium, osmium, tin, iron, cobalt, nickel, molybdenum, tungsten, vanadium, and a material formed by mixing any one or more thereof.

In addition, as an example, the cathode 230 may be formed of any one material of tin, tin alloy, aluminum, gold, silver, carbon, cadmium, cobalt, chromium, copper, copper alloy, gallium, mercury, indium, molybdenum, niobium, nickel, NiCo2O4, nickel alloy, nickel-iron alloy, lead, rhodium, titanium, vanadium, tungsten, zinc, elgiloy, nichrome, austenitic steel, duplex steel, ferritic steel, martensitic steel, stainless steel, and a material formed by mixing any one or more thereof.

A process in which ammonia is decomposed in the anode 220 and the cathode 230 may be expressed by the following reaction equation.

Chemical equation at the anode 220:

$$3NH_2^- \rightarrow \frac{1}{2}N_2 + 2NH_3 + 3e^-,\ E_o = 0.039\ \text{V}$$

Chemical equation at the cathode 230:

$$3NH_3 + 3e^- \rightarrow \frac{3}{2}H_2 + 3NH_2^-,\ E_o = -0.038\ \text{V}$$

Entire chemical equation:

$$NH_3 \rightarrow \frac{1}{2}N_2 + \frac{3}{2}H_2,\ E_o = 0.077\ \text{V}$$

That is, $3NH_2^-$ ion decomposed in the supplied electrolyte material, ammonia, is catalytically reacted at the anode 220 to generate nitrogen and electron. The generated electron is moved to the cathode 230. In the cathode 230, the moved electron and $3NH_3$ are reduced by a reduction reaction to generate hydrogen. Accordingly, the nitrogen and hydrogen are included in the at least two fluids.

Any one fluid generated at the anode 220 of the at least two fluids, that is, the nitrogen in above Equation 1, and the other fluid generated at the cathode 230 of the at least two fluids, that is, the hydrogen in above Equation 1 may be discharged to the fluid separator 300 through the mixing passage 513 of the passage unit 510.

As will be described later, the fluid separator 300 may include a first fluid separator 300*a* for collecting the any one fluid, that is, nitrogen, and a second fluid separator 300*b* for collecting the other fluid, that is, hydrogen. Similarly, the mixing passage 513 includes a first mixing passage 513*a* communicating the anode 220 and the first fluid separator 300*a* and a second mixing passage 513*b* communicating the cathode 230 and the second fluid separator 300*b*.

Accordingly, the at least two fluids generated at the anode 220 and the cathode 230, respectively, nitrogen and hydrogen in the above embodiment are not mixed with each other and may flow to different fluid separators (i.e., the first fluid separator 300*a* and the second fluid separator 300*b*) through separate passages (i.e., the first mixing passage 513*a* and the second mixing passage 513*a*), respectively.

Accordingly, a separate process for separating the nitrogen and hydrogen generated by the electrolysis of ammonia is not required. As a result, a separate member for separating the generated nitrogen and hydrogen is also not required, so that the configuration of the system and process for electrolyzing ammonia to generate nitrogen and hydrogen can be simplified.

The above-described embodiment has been described on the assumption that a potential difference between the anode 220 and the cathode 230 formed by the current applied from the controller 400 is 0.077 V. Alternatively, a potential difference between the anode 220 and the cathode 230 may be set to any value in a range of 0.1 V to 4 V.

The value of the potential difference may be determined to be an arbitrary value to which the anode 220 and the cathode 230 may not be damaged by the applied current.

In order to prevent damage to the anode 220 and the cathode 230 as the electrolytic cell 200 operates, various components for sensing the states of the anode 220 and cathode 230 may be provided. This will be described in the description of the utility unit 500 to be described later.

The membrane member 240 is positioned between the anode 220 and the cathode 230 to restrict any movement of the ammonia introduced into the anode 220 or any one fluid generated at the anode 220 to the cathode 230. In addition, the membrane member 240 restricts any movement of the ammonia introduced into the cathode 230 or the other fluid generated at the cathode 230 to the anode 220.

The membrane member 240 is positioned inside the electrolytic cell housing 210. Specifically, the membrane member 240 is positioned between the first cell housing 211 and the second cell housing 212, and thus, positioned between the anode 220 and the cathode 230 respectively accommodated in the inner space of the first cell housing 211 and the inner space of the second cell housing 212.

The membrane member 240 may be provided in a shape corresponding to the shape of the electrolytic cell housing 210. As described above, the electrolytic cell housing 210 is provided in a disk shape, and the membrane member 240 may also be provided in a disk shape. In this case, the diameter of the membrane member 240 is formed smaller than the diameter of the electrolytic cell housing 210, and the membrane member 240 may not be exposed to the outside.

The membrane member 240 may be provided in any shape capable of blocking any communication of the respective spaces in which the anode 220 and the cathode 230 are accommodated.

For example, the membrane member 240 may be formed of a ceramic material, so that only a material formed of molecules of a predetermined size or less can pass therethrough. In this embodiment, the membrane member 240 may function as a kind of filter.

As another example, the membrane member 240 may be provided in the form of an ionomer to prevent any movement of specific ions. In this case, the membrane member 240 may be configured to prevent any movement of any one or more of cations and anions.

In an embodiment, the membrane member 240 may be formed any material of poly (perfluorosulfonic acid), poly (perfluorocarboxylic acid) sulfonic acid group, tetrafluoroethylene, fluorovinyl ether, polyvinylidene, fluoride (PVDF), polyamide, polyester, polysulfone, polyethylene, polypropylene, styrene, acrylic acid, methacrylic acid, glycidyl acrylate, glycidyl methacrylate, polyethylene glycol diacrylate, 1,3-butylene glycol diacrylate, ethylene glycol dimethacrylate, cellulose, sulfonated polyimide, sulfonated polyaryl ether sulfone, sulfonated polyether ether ketone, sulfonated poly benzimidazole, sulfonated polysulfone, sulfonated polystyrene, sulfonated polyphosphazene, sulfonated polyetherethersulfone, sulfonated polyethersulfone, sulfonated polyetherbenzimidazole, sulfonated polyaryleneetherketone, sulfonated polyetherketone, sulfonated polystyrene, sulfonated polyimidazole, sulfonated polyether ketone ketone, polyarylether benzimidazole, and a material formed by mixing any one or more thereof.

In the above embodiment, the membrane member 240 may block any movement of $NH_2^+$ ions. Therefore, it will be understood that the nitrogen generated at the anode 220 and the hydrogen generated at the cathode 230, as in Equation 1 above, are not mixed with each other.

In the above embodiment, the membrane member 240 may be configured to promote the electrolysis process of ammonia.

The diffusion member 250 diffuses the fluid accommodated in the first cell housing 211 in which the anode 220 is accommodated or the fluid accommodated in the second cell housing 212 in which the cathode 230 is accommodated. Accordingly, the area in which each accommodated fluid is in contact with the anode 220 and the cathode 230 is increased, so that the chemical reaction according to the above Equation 1 may proceed more actively.

The diffusion member 250 may be provided in any shape capable of accelerating diffusion of a fluid and a chemical reaction. In an embodiment, the diffusion member 250 may be formed of a porous material.

The diffusion member 250 is accommodated in the electrolytic cell housing 210. The diffusion member 250 is positioned adjacent to the anode 220 and the cathode 230.

The diffusion member 250 may be provided in plurality. A plurality of the diffusion members 250 may be positioned adjacent to the anode 220 and the cathode 230, respectively. In the illustrated embodiment, the diffusion member 250 includes a first diffusion member 251 positioned adjacent to the anode 220 and a second diffusion member 252 positioned adjacent to the cathode 230.

In the above embodiment, the first diffusion member 251 may be accommodated in the inner space of the first cell housing 211. Similarly, the second diffusion member 252 may be accommodated in the inner space of the second cell housing 212.

In the illustrated embodiment, the first diffusion member 251 is disposed to face the membrane member 240 with the anode 220 interposed therebetween. In addition, the second diffusion member 252 is disposed to face the membrane member 240 with the cathode 230 interposed therebetween. That is, the diffusion member 250 is positioned relatively outward compared to the anode 220 or the cathode 230.

The position of the diffusion member 250 may be changed according to a position where the electrolytic cell housing 210 communicates with the outside.

The gasket member 260 is positioned between the first cell housing 211 and the second cell housing 212 to block the communication between the inner spaces of the first cell housing 211 and second cell housing 212 and the outside.

The gasket member 260 may be provided in a plate shape. In this case, the gasket member 260 may be provided in a ring shape having a hollow formed therein. The membrane member 240 may be accommodated in the hollow formed inside the gasket member 260. The outer periphery surrounding the hollow of the gasket member 260 may be in close contact with the first cell housing 211 and the second cell housing 212, respectively.

Accordingly, the membrane member 240 positioned between the first cell housing 211 and the second cell housing 212 may be stably maintained in a coupled state. In addition, the inner spaces of the first cell housing 211 and second cell housing 212 may be blocked from any communication with the outside.

The cell temperature controller 270 may constantly maintain the temperature of the ammonia accommodated in a space (that is, the respective spaces formed in the first cell housing 211 and the second cell housing 212) formed in the electrolytic cell housing 210 and the temperature of the at least two fluids generated by electrolysis of the ammonia.

The cell temperature controller 270 serves to control the temperature so that the ionic additive is not precipitated in the electrolytic reaction. The cell temperature controller 270 is connected to the electrolytic cell housing 210 and is configured to transmit or receive thermal energy.

In one embodiment, the cell temperature controller 270 may be connected to the electrolytic cell housing 210, as well as the passage unit 510 connecting the electrolytic cell 200 and the mixer 100 or the electrolytic cell 200 and the fluid separator 300.

In the above embodiment, the cell temperature controller 270 may constantly maintain not only the temperature of the electrolytic cell housing 210, but also the temperature of the passage unit 510 through which ammonia, additive-mixed ammonia, or at least two fluids generated by electrolysis of ammonia flow.

In one embodiment, the cell temperature controller 270 may maintain the temperatures of the electrolytic cell housing 210 and the ammonia or additive-mixed ammonia accommodated in the electrolytic cell housing 210 within a range of −80° C. to 135° C., and may preferably maintain the temperatures within a range of −50° C. to 120° C. When the temperature is less than −80° C., it may not be economical because insulation for maintaining the temperature condition of the electrolytic cell 200 is difficult, and the solubility of the ionic additive is lowered due to the low temperature and precipitated, so the electrolytic reactivity may be reduced. Conversely, when the temperature exceeds 135° C., it may not be economical because a separate heat source for maintaining the temperature of the electrolytic cell 200 must be provided, and it may cause deterioration of performance and deterioration of durability due to the deterioration of the membrane member disposed between the anode and the cathode, resulting in reduced electrolytic reactivity.

The cell temperature controller 270 may be provided in any form capable of maintaining a constant temperature of itself or of another member. In one embodiment, the cell temperature controller 270 may be provided in the form of a chiller.

(3) Fluid Separator 300

The fluid separator 300 receives at least two fluids generated by electrolysis of ammonia in the electrolytic cell 200. The fluid separator 300 further separates the unreacted ammonia contained in the at least two fluids received. Accordingly, ammonia does not remain in the at least two fluids that have passed through the fluid separator 300.

As a result, each fluid discharged from the fluid separator 300 may be composed of a pure material in which other fluids are not mixed. Accordingly, the discharged fluid may be supplied to a necessary component without going through an additional process.

In an embodiment in which ammonia is provided in a liquid phase, the fluid separator 300 may function as a gas-liquid separator to separate ammonia in a liquid phase from nitrogen and oxygen in a gas phase.

The fluid separator 300 may be provided in any form capable of separating different fluids. In one embodiment, the fluid separator 300 may be configured to separate different fluids through thermal separation, density difference separation, centrifugal separation, or the like.

In the fluid separator 300, unreacted gaseous ammonia and liquid ammonia (including ionic additives) may exist in a mixed state, and the hydrogen gas (gas phase) and nitrogen gas (gas phase) generated through the ammonia electrolytic reaction are included. By controlling the temperature in the fluid separator, only ammonia is selectively liquefied, and a product (hydrogen gas and nitrogen gas) is primarily separated by using the density difference according to the phase, and a trace amount of gaseous ammonia not liquefied in the above step may be finally separated from the product (hydrogen gas and nitrogen gas) through a trap member 320.

The fluid separator 300 is in communication with the electrolytic cell 200. At least two fluids generated by electrolysis of ammonia in the electrolytic cell 200 and a mixed fluid in which ammonia is mixed with the at least two fluids may flow to the fluid separator 300.

Specifically, the fluid separator 300 may communicate with the electrolytic cell 200 by the mixing passage 513 provided in the passage unit 510 of the utility unit 500.

The fluid separator 300 may communicate with an external component (not shown). For example, the fluid separator 300 may communicate with the bombe B, a fuel cell operated using hydrogen as fuel, a device for performing a denitrification process, or the like.

The fluid separator 300 is electrically connected to the controller 400. The power required to operate the fluid separator 300 may be transmitted from the controller 400. Also, the operation of the fluid separator 300 may be controlled according to a control signal applied from the controller 400.

The fluid separator 300 may be provided in plurality. A plurality of the fluid separators 300 may be in communication with the electrolytic cell 200, respectively, and may receive different fluids from among at least two fluids generated in the electrolytic cell 200, respectively.

In the illustrated embodiment, two fluid separators 300 including a first fluid separator 300*a* and a second fluid separator 300*b* are provided. The first fluid separator 300*a* and the second fluid separator 300*b* may be connected to the anode 220 and the cathode 230, respectively.

In other words, the first fluid separator 300*a* communicates with the inner space of the first cell housing 211 accommodating the anode 220. The second fluid separator 300*b* communicates with the inner space of the second cell housing 212 accommodating the cathode 230.

In an embodiment in which ammonia is electrolyzed to generate nitrogen and hydrogen in the electrolytic cell 200, nitrogen and hydrogen may be introduced into the first fluid separator 300*a* and the second fluid separator 300*b*, respectively.

In the illustrated embodiment, the fluid separator 300 includes a separator body 310, a trap member 320, and a separation temperature controller 330.

The separator body 310 forms a portion of the outer shape of the fluid separator 300. A space is formed inside the separator body 310. The mixed fluid of nitrogen, hydrogen and nitrogen, or hydrogen and ammonia electrolyzed in the electrolytic cell 200 may be accommodated in the space.

The space of the separator body 310 communicates with the outside. Specifically, the separator body 310 communicates with the electrolytic cell 200 and the trap member 320. The communication may be formed by the passage unit 510 provided in the utility unit 500.

In the illustrated embodiment, the separator body 310 includes an inlet 311 and an outlet 312.

The inlet 311 is a portion where the separator body 310 communicates with the electrolytic cell 200. The inlet 311 may be formed to be opened to communicate the mixing passage 513 of the passage unit 510 with the inner space of the separator body 310. The electrolyzed nitrogen, hydrogen and nitrogen or a mixed fluid of hydrogen and ammonia may be introduced into the inner space of the separator body 310 through the inlet 311.

The outlet 312 is a portion where the separator body 310 communicates with the trap member 320. The outlet 312 may be formed to be opened to communicate the discharge passage 514 of the passage unit 510 with the inner space of the separator body 310. The nitrogen or oxygen that has undergone the separation process of ammonia may flow toward the trap member 320 through the outlet 312.

The trap member 320 further separates the ammonia remaining in the fluid that has undergone the separation process of ammonia in the separator body 310.

The trap member 320 communicates with the separator body 310. Specifically, the trap member 320 may communicate with the outlet 312 of the separator body 310 through the discharge passage 514 of the passage unit 510. The trap member 320 may receive any one of the at least two fluids discharged from the separator body 310.

The trap member 320 communicates with an external component. The ammonia, nitrogen, and hydrogen separated through the trap member 320 may be transferred to different components along different passages, respectively.

Trap members 320 may be provided in plurality. A plurality of the trap members 320 may be configured to sequentially separate the ammonia mixed in the fluid that has passed through the separator body 310.

Figure 6:
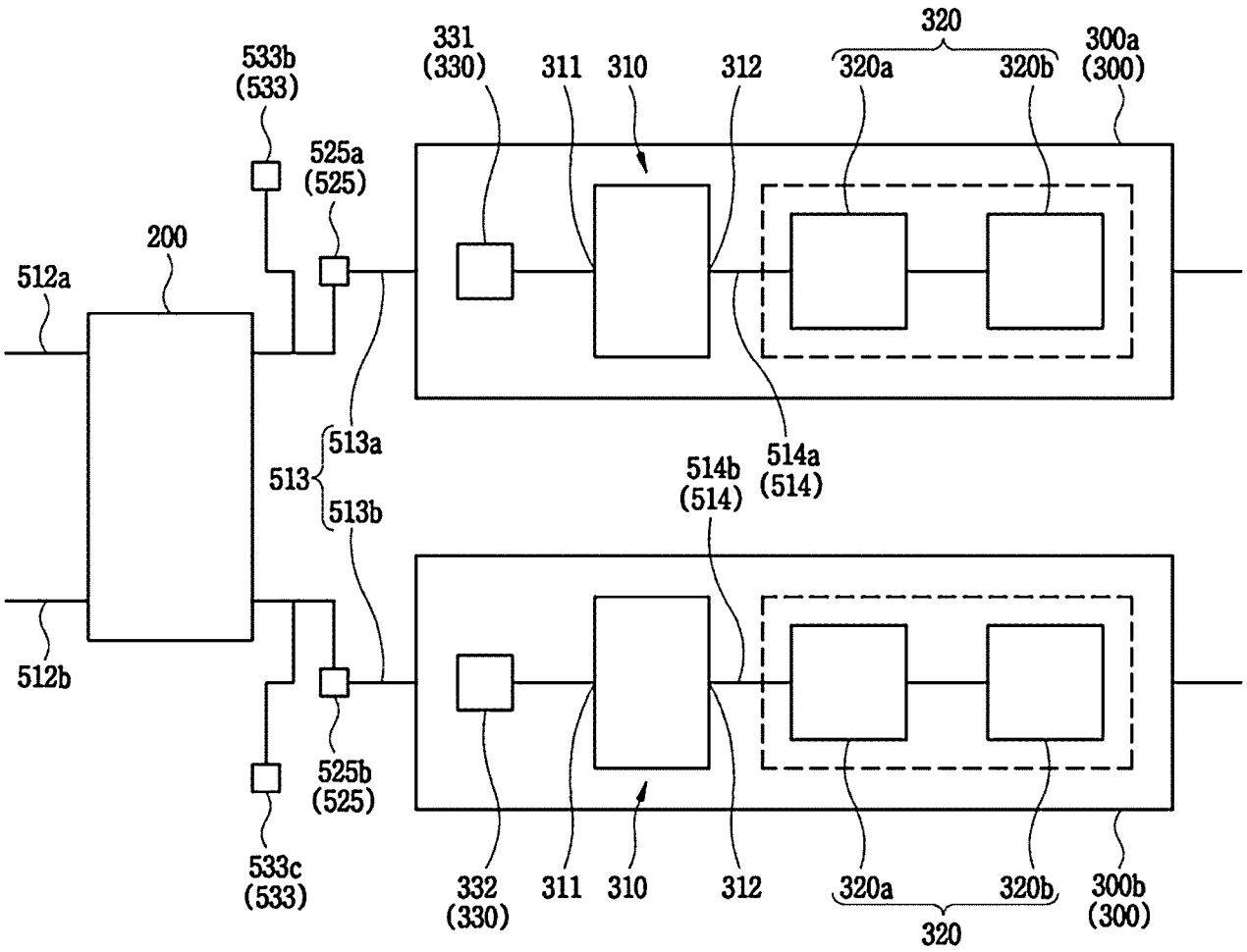
FIG. 6 is a block diagram illustrating a connection relationship between an electrolytic cell and fluid separator provided in the ammonia electrolysis system of FIG. 1.

In the embodiment illustrated in FIG. 6, two trap members 320 including a first trap member 320*a* and a second trap member 320*b* are provided. The fluid introduced from the separator body 310 sequentially passes through the first trap member 320*a* and the second trap member 320*b*, and may be separated from the residual ammonia.

The separation temperature controller 330 constantly maintains the temperatures of at least two fluids accommodated in the space formed inside the separator body 310 and the trap member 320 and ammonia mixed with the fluids. The separation temperature controller 330 serves to control the temperature to selectively separate the unreacted ammonia after the ammonia electrolytic reaction and the product. The separation temperature controller 330 is connected to the separator body 310 and the trap member 320 to transmit or receive thermal energy.

In one embodiment, the separation temperature controller 330 may be connected to the separator body 310 and the trap member 320, as well as the passage unit 510 connecting the separator body 310 and the electrolytic cell 200 and the passage unit 510 connecting the separator body 310 and the trap member 320.

In the above embodiment, the separation temperature controller 330 may constantly maintain the temperatures of the separator body 310 and the trap member 320, as well as the fluid discharged from the electrolytic cell 200, the fluid flowing from the separator body 310 to the trap member 320.

The separation temperature controller 330 may preferably control the temperature within a range of −80° ° C. to 135° C. in order to maintain the ammonia in a liquid phase, and −50° C. to 120° C. in order to effectively separate the unreacted ammonia after the electrolytic reaction from the product. When the temperature is less than −80° C., it may not be economical because insulation for maintaining the temperature condition of the fluid separator 300 is difficult. Conversely, when the temperature exceeds 135° C., it may not be economical because a separate heat source must be provided for maintaining the temperature of the fluid separator 300, and it may be difficult to separate the unreacted ammonia from gaseous products because the specific gravity of unreacted ammonia in the gaseous phase may increase.

The separation temperature controller 330 may be provided in any form capable of maintaining a constant temperature of itself or of other members. In one embodiment, the separate temperature controller 330 may be provided in the form of a chiller.

(4) Controller 400

The controller 400 is electrically connected to each component of the ammonia electrolysis system 10, and supplies power for operating each component. In addition, the controller 400 receives information about the operating state of each component of the ammonia electrolysis system 10 and controls each component of the ammonia electrolysis system 10 by calculating control information corresponding to the received information.

The controller 400 may be provided in any form capable of inputting, outputting, calculating, and storing information. In one embodiment, the controller 400 may be provided in a form in which a means for processing information such as a CPU or a microprocessor and a means for storing information such as an HDD, an SSD, and a micro SD are combined.

The controller 400 is electrically connected to the mixer 100. The controller 400 may supply the power required for the operation of the mixer 100 and control the operation of the mixer 100.

The controller 400 is electrically connected to the electrolytic cell 200. The controller 400 may supply the power required for the operation of the electrolytic cell 200 and control the operation of the electrolytic cell 200.

The controller 400 is electrically connected to the fluid separator 300. The controller 400 may supply the power required for the operation of the fluid separator 300 and control the operation of the fluid separator 300.

The controller 400 is electrically connected to the utility unit 500. The controller 400 may receive the information sensed by the utility unit 500. The received information may be used by the controller 400 to calculate control information for controlling the mixer 100, the electrolytic cell 200, the fluid separator 300, and the utility unit 500.

In addition, the controller 400 may supply the power required for the operation of the utility unit 500 and control the operation of the utility unit 500.

In addition, the controller 400 may control the temperature, pressure, and voltage of the components of the ammonia electrolysis system 10, that is, the mixer 100, the electrolytic cell 200, the fluid separator 300, and the utility unit 500. To this end, the controller 400 may include a device (not shown) for controlling the flow rate, pressure, and temperature of the ammonia or generated fluid. Furthermore, the controller 400 may include a device (not shown) for controlling the magnitude of the current applied to the anode 220 and the cathode 230.

(5) Utility Unit 500

The utility unit 500 allows or blocks the communication between the respective components of the ammonia electrolysis system 10. In addition, the utility unit 500 senses information about the state of each component of the ammonia electrolysis system 10.

The information sensed by the utility unit 500 may be transmitted to the controller 400. Also, the operation of the utility unit 500 may be performed according to the control information calculated by the controller 400.

In the illustrated embodiment, the utility unit 500 includes the passage unit 510, a valve unit 520, and a sensor unit 530.

The passage unit 510 connects the respective components of the ammonia electrolysis system 10 in a fluid communication manner.

The passage unit 510 may be provided in any shape capable of communicating two or more members different from each other. In one embodiment, the passage unit 510 may be provided in the form of a pipe, a tube, a hollow, a duct, or the like.

In the illustrated embodiment, the passage unit 510 includes the inflow passage 511, the supply passage 512, the mixing passage 513, and a discharge passage 514.

The inflow passage 511 communicates the bombe B and the mixer body 110. The ammonia accommodated in the bombe B may be introduced into the inner space of the mixer body 110 along the inflow passage 511.

The inflow passage 511 may be configured to allow or block communication between the bombe B and the inner space of the mixer body 110. To this end, a member for controlling the flow of the fluid, such as a valve (not shown), may be provided in the inflow passage 511. In the above embodiment, the valve (not shown) may be controlled by the controller 400 or an operator.

The supply passage 512 communicates the mixture body 110 and the electrolytic cell 200. The ammonia or mixed fluid of ammonia and additive of which temperature is controlled in the mixer body 110 may be introduced into the inner space of the electrolytic cell 200 along the supply passage 512.

A discharge valve 523 is disposed on the supply passage 512. The discharge valve 523 may be controlled by the controller 400 or an operator to allow or block communication between the supply passage 512 and the electrolytic cell 200.

The supply passage 512 may be introduced with any one or more of the at least two fluids. That is, in the embodiment illustrated in FIG. 2, the supply passage 512 may communicate with or be blocked from the nitrogen and hydrogen supply passages (not indicated by reference numerals) whose opening and closing are controlled by a gas supply valve 522.

The supply passage 512 may be branched into a plurality of passages. In the illustrated embodiment, the supply passage 512 may be branched into a first supply passage 512*a* and a second supply passage 512*b*. The first supply passage 512*a* may communicate with the first cell housing 211 of the electrolytic cell housing 210. The second supply passage 512*b* may communicate with the second cell housing 212 of the electrolytic cell housing 210.

Accordingly, when the amounts of ammonia supplied to the anode 220 and the cathode 230 are different, the opening and closing of one or more of the first supply passage 512*a* and the second supply passage 512*b* may be controlled.

The mixing passage 513 communicates with the electrolytic cell 200 and the fluid separator 300. The at least two fluids (e.g., nitrogen and oxygen) generated by electrolysis of ammonia in the electrolytic cell 200 may flow to the fluid separator 300 along the mixing passage 513.

As described above, the fluid separator 300 may be provided in plurality to receive different fluids. The mixing passage 513 may also be provided in plurality to communicate the electrolytic cell 200 and each of the plurality of fluid separators 300.

In the illustrated embodiment, two mixing passages 513 including a first mixing passage 513*a* and a second mixing passage 513*b* are provided.

The first mixing passage 513*a* communicates the inner space of the first cell housing 211 in which the anode 220 is accommodated and the first fluid separator 300*a*. Nitrogen and ammonia mixed the nitrogen may flow on the first mixing passage 513*a*.

The second mixing passage 513*b* communicates the inner space of the second cell housing 212 in which the cathode 230 is accommodated and the second fluid separator 300*b*. Hydrogen and ammonia mixed the hydrogen may flow on the second mixing passage 513*b*.

The discharge passage 514 communicates the separator body 310 and trap member 320 of the fluid separator 300. The fluid that has undergone the separation process of ammonia in the separator body 310 may flow to the trap member 320 along the discharge passage 514.

As described above, since the fluid separator 300 is provided in plurality, the discharge passage 514 may also be provided in plurality to form passages through which different fluids flow. In the illustrated embodiment, two discharge passage 514 includes by including a first discharge passage 514*a* that communicates the respective components of the first fluid separator 300*a* and a second discharge passage 514*b* that communicates the respective components of the second fluid separator 300*b*.

The valve unit 520 is provided on the passage unit 510 to allow or block communication of the passage unit 510. By means of the valve unit 520, the respective components of the ammonia electrolysis system 10 may be communicated with or blocked from each other.

The valve unit 520 may be provided in any shape capable of allowing or blocking the flow of a fluid. In addition, the valve unit 520 may be provided in any shape capable of restricting the flow direction of the fluid.

The operation of the valve unit 520 may be controlled by the controller 400 or an operator. In the embodiment in which the valve unit 520 is controlled by the controller 400, the valve unit 520 may be electrically connected to the controller 400.

In particular, the ammonia electrolysis system 10 according to an embodiment of the present invention may be configured to control the operation of the valve unit 520 according to the information sensed by the sensor unit 530. A detailed description thereof will be described later.

In the illustrated embodiment, the valve unit 520 includes a pressure control valve 521, a gas supply valve 522, a discharge valve 523, a supply valve 524, a mixing valve 525, and a discharge valve 526.

The pressure control valve 521 is configured to control the internal pressure of the mixer body 110 by allowing or blocking the communication between the mixer body 110 and the outside. As the pressure control valve 521 is operated, the ammonia accommodated in the mixer body 110 may be maintained in a required phase. Apparently, it will be appreciated that the mixing temperature controller 140 also operates together for this purpose.

The gas supply valve 522 is configured to supply or block nitrogen or hydrogen from an external source. The gas supply valve 522 is disposed on the gas supply passage (not indicated by a reference numeral) communicating with the supply passage 512 on the upstream side (that is, a position biased toward the mixer body 110) of the supply passage 512. The gas supply valve 522 may open or close the gas supply passage (not indicated by a reference numeral).

The discharge valve 523 is disposed in the supply passage 512, and is configured to allow or block the communication between the mixer body 110 and the electrolytic cell 200. The discharge valve 523 may be positioned on the upstream side of the supply passage 512. In one embodiment, the discharge valve 523 may be positioned upstream from the position of the gas supply passage (not indicated by a reference numeral) that is opened or closed by the gas supply valve 522.

The supply valve 524 is configured to open or close the first supply passage 512*a* and second supply passage 512*b* branched from the supply passage 512. The supply valve 524 may be provided in plurality, and a plurality of the supply valves 524 may be provided in the plurality of supply passages, respectively.

In the illustrated embodiment, two supply valves 524 including a first supply valve 524*a* and a second supply valve 524*b* are provided. The first supply valve 524*a* is disposed in the first supply passage 512*a*, and is configured to open or close the first supply passage 512*a*. The second supply valve 524*b* is disposed in the second supply passage 512*b* and is configured to open or close the second supply passage 512*b*.

The mixing valve 525 is disposed in the mixing passage 513, and is configured to allow or block the communication between the electrolytic cell 200 and the fluid separator 300. The mixing valve 525 may be provided in plurality, and a plurality of the mixing valves 525 may be provided in the plurality of mixing passages, respectively.

In the illustrated embodiment, two mixing valves 525 including a first mixing valve 525*a* and a second mixing valve 525*b* are provided. The first mixing valve 525*a* is disposed in the first mixing passage 513*a* and configured to open or close the first mixing passage 513*a*. The second mixing valve 525*b* is disposed in the second mixing passage 513*b* and is configured to open or close the second mixing passage 513*b*.

The discharge valve 526 is disposed in the discharge passage 514 and is configured to allow or block the communication between the separator body 310 and the trap member 320. The discharge valve 526 may be provided in plurality and a plurality of the discharge valves 526 may be provided in the plurality of discharge passages, respectively.

In the illustrated embodiment, two discharge valves 526 including a first discharge valve 526*a* and a second discharge valve 526*b* may be provided. The first discharge valve 526*a* is disposed in the first discharge passage 514*a* and is configured to open or close the first discharge passage 514*a*. The second discharge valve 526*b* is disposed in the second discharge passage 514*b* and is configured to open or close the second discharge passage 514*b*.

The sensor unit 530 senses information about the state of each component of the ammonia electrolysis system 10. Each information sensed by the sensor unit 530 is transmitted to the controller 400, and is used to calculate control information for controlling each component of the ammonia electrolysis system 10. The sensor unit 530 is electrically connected to the controller 400.

The sensor unit 530 may sense information in any form capable of sensing the state of the ammonia electrolysis system 10. For example, the sensor unit 530 may be configured to sense temperature, pressure, flow rate, level, or the like.

A detailed description of a process in which each component of the ammonia control system 10 is controlled according to the information sensed by the sensor unit 530 will be described later.

In the illustrated embodiment, the sensor unit 530 includes a temperature sensor 531, a flow sensor 532, a pressure sensor 533, a level sensor 534, and a voltage sensor 535.

The temperature sensor 531 senses information about the temperature of the components of the ammonia electrolysis system 10. The information sensed by the temperature sensor 531 is transmitted to the controller 400, and the sensed information is used to calculate control information for controlling the operation of the mixer 100, electrolytic cell 200 or valve unit 520 by the controller.

In the illustrated embodiment, the temperature sensor 531 includes a mixing temperature sensor 531*a* and a cell temperature sensor 531*b*.

The mixing temperature sensor 531*a* is disposed adjacent to the mixer body 110 and is configured to sense the temperature of the inner space of the mixer body 110 and the ammonia or mixed fluid of ammonia and additive accommodated in the inner space of the mixer body 110.

The cell temperature sensor 531*b* is disposed adjacent to the electrolytic cell 200, and is configured to sense the temperature of the inner space of the electrolytic cell 200 and the temperatures of the anode 220, cathode 230 and electrolyzed at least two fluids accommodated therein, respectively.

The flow sensor 532 is configured to sense the flow rate of ammonia or mixed fluid of ammonia and additives supplied to the inner space of the electrolytic cell 200. The flow sensor 532 is disposed in the supply passage 512 that communicates the mixer body 110 and the electrolytic cell 200.

The information sensed by the flow sensor 532 is transmitted to the controller 400, and is used to calculate control information for controlling the operation of the mixer 100, electrolytic cell 200 or valve unit 520 by the controller 400.

The flow sensor 532 may be provided in plurality. A plurality of the flow sensors 532 may be disposed on the first supply passage 512*a* and second supply passage 512*b* branched from the supply passage 512, respectively. In the illustrated embodiment, the flow sensor 532 includes a first flow sensor 532*a* connected to the first supply passage 512*a* and a second flow sensor 532*b* connected to the second supply passage 512*b*.

The first flow sensor 532*a* is configured to sense the flow rate of the fluid flowing into the space accommodating the anode 220, that is, the inner space of the first cell housing 211. The second flow sensor 532*b* is configured to sense the flow rate of the fluid flowing into the space accommodating the cathode 230, that is, the inner space of the second cell housing 212.

The pressure sensor 533 is disposed adjacent to the mixer 100 and the electrolytic cell 200, and is configured to sense the pressure of the inner spaces of the mixer 100 and electrolytic cell 200. The information sensed by the pressure sensor 533 is transmitted to the controller 400, and is used to calculate the control information for controlling the operation of the mixer 100, electrolytic cell 200, or valve unit 520 by the controller 400.

The pressure sensor 533 may be provided in plurality. A plurality of the pressure sensors 533 is provided in the mixer 100 and the electrolytic cell 200, respectively, and may be configured to sense pressures in different spaces. As an example, the pressure sensor 533 may be configured to sense the internal pressure of the mixer body 110 and the pressure of a space in which the anode 220 and the cathode 230 are accommodated, that is, the inner space of the first cell housing 211 and the inner space of the second cell housing 212.

In the illustrated embodiment, three pressure sensors 533 including a first pressure sensor 533*a*, a second pressure sensor 533*b*, and a third pressure sensor 533*c* are provided.

The first pressure sensor 533*a* is configured to sense the internal pressure of the mixer body 110. The second pressure sensor 533*b* is configured to sense the pressure of the inner space of the first cell housing 211 accommodating the anode 220. The third pressure sensor 533*c* is configured to sense the pressure of the inner space of the second cell housing 212 accommodating the cathode 230.

The level sensor 534 is configured to sense the level of ammonia or mixed fluid of ammonia and additive accommodated in the mixer body 110. The information sensed by the level sensor 534 is transmitted to the controller 400 and used to calculate the control information for controlling the operation of the mixer 100 or valve unit 520. The level sensor 534 is positioned adjacent to the mixer body 110.

The voltage sensor 535 is configured to sense a potential difference between the anode 220 and the cathode 230, that is, a voltage, as the current applied to the electrolytic cell 200 and the electrolysis of ammonia proceed. The information sensed by the voltage sensor 535 is transmitted to the controller 400, and is used to calculate the control information for controlling the operation of the electrolytic cell 200 or the magnitude of the current applied to the electrolytic cell 200. The voltage sensor 535 is positioned adjacent to the electrolytic cell 200.

3. Ammonia Electrolysis System 20 According to Another Embodiment

Figure 7:
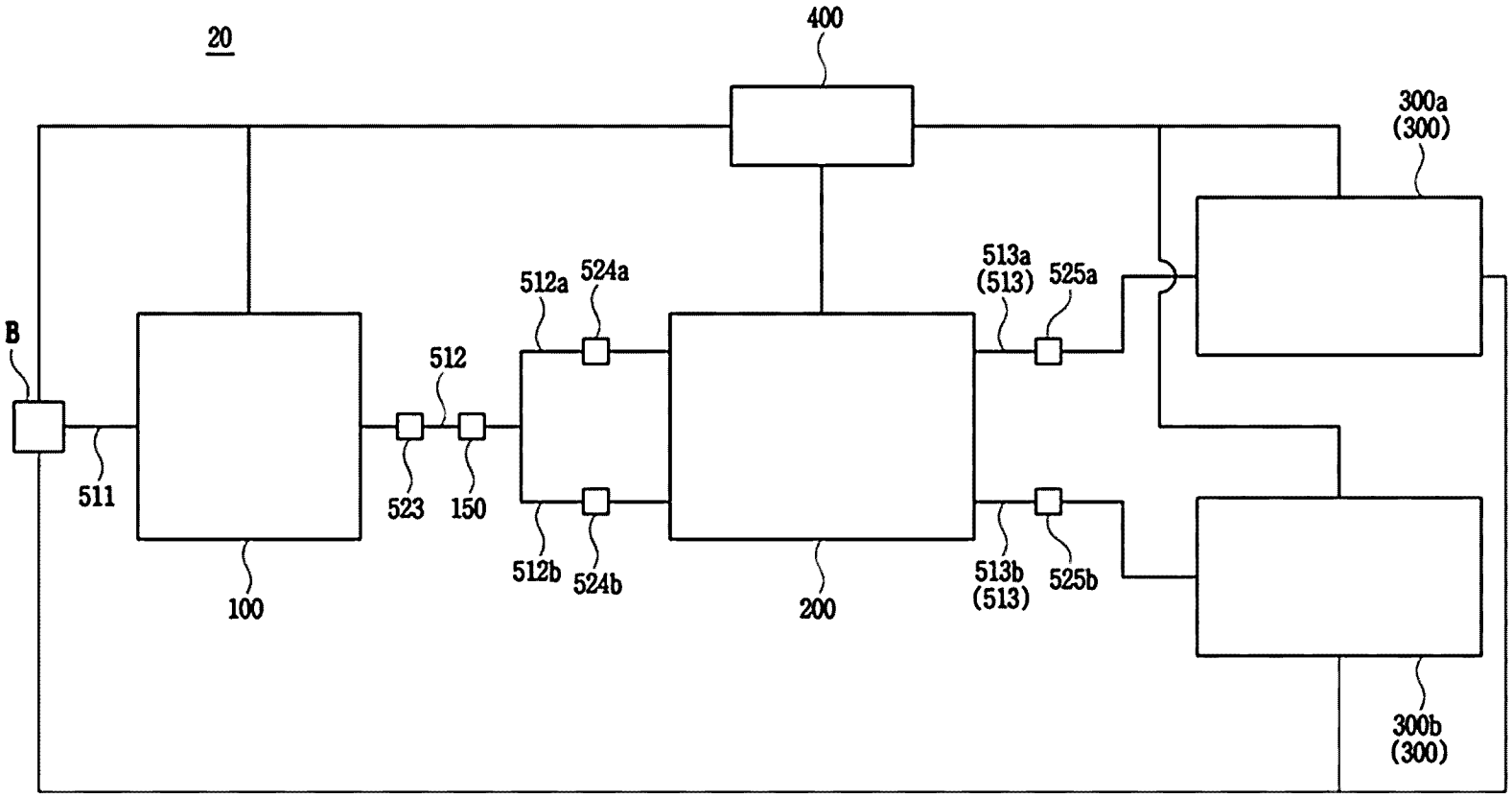
FIG. 7 is a block diagram illustrating the configuration of an ammonia electrolysis system according to another embodiment of the present invention.
Figure 8:
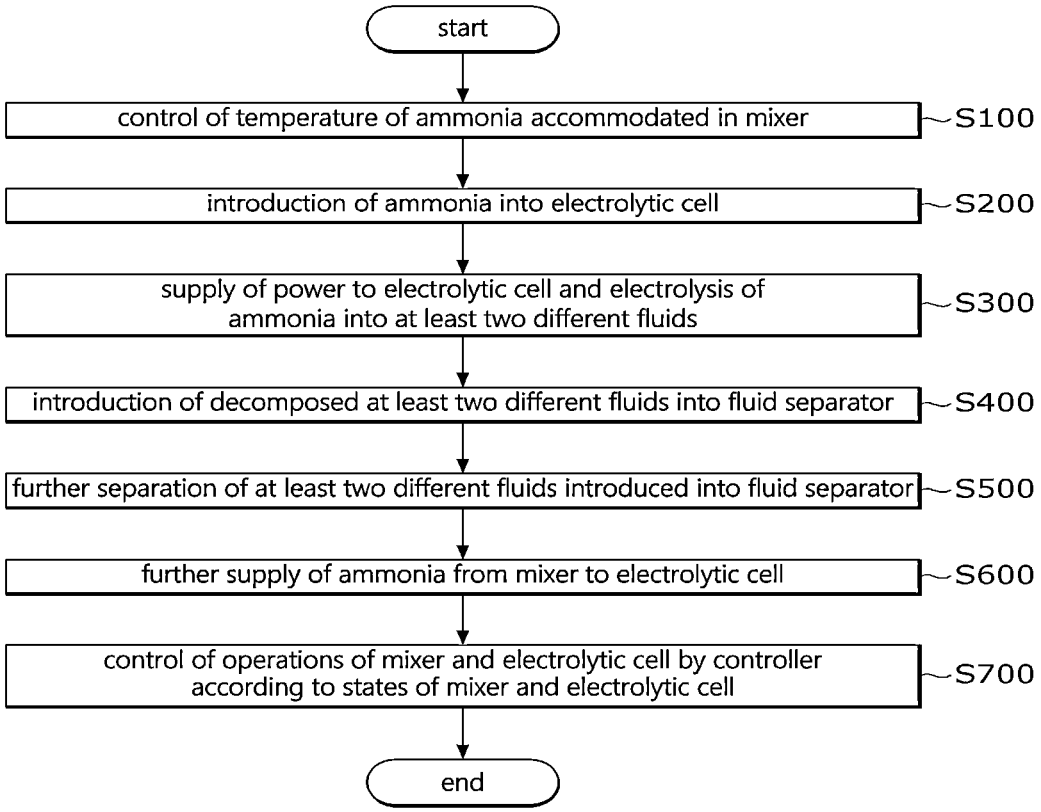
FIG. 8 is a flowchart illustrating a flow of a control method of an ammonia electrolysis system according to an embodiment of the present invention.
Figure 9:
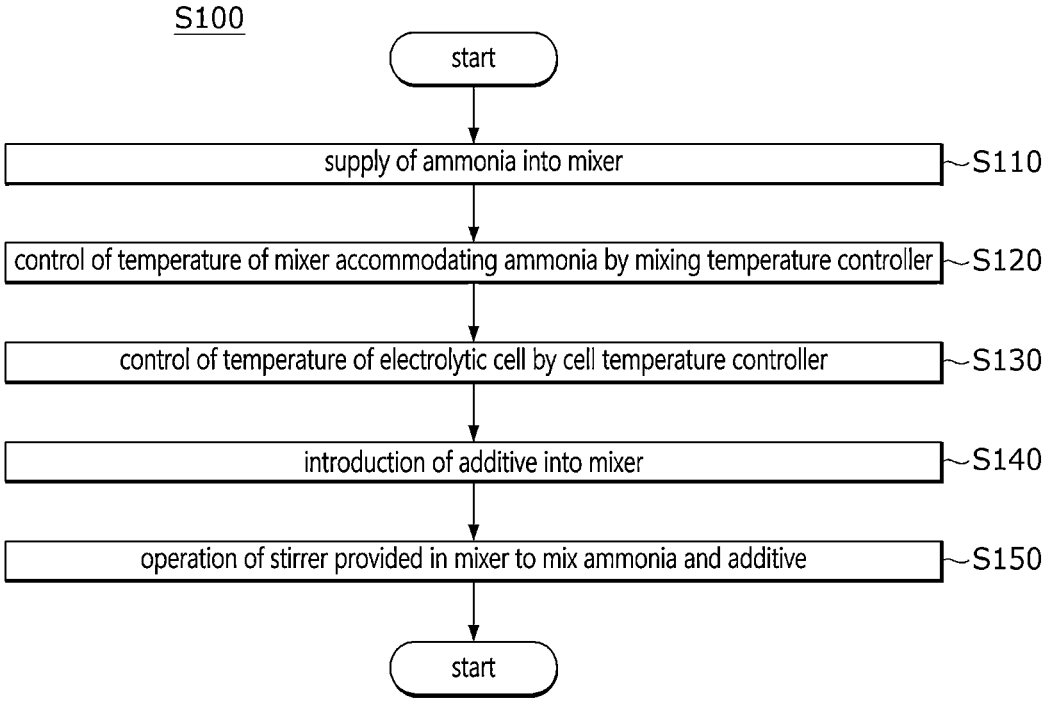
FIG. 9 is a flowchart illustrating a detailed flow of step S100 of the control method of the ammonia electrolysis system of FIG. 8.
Figure 10:
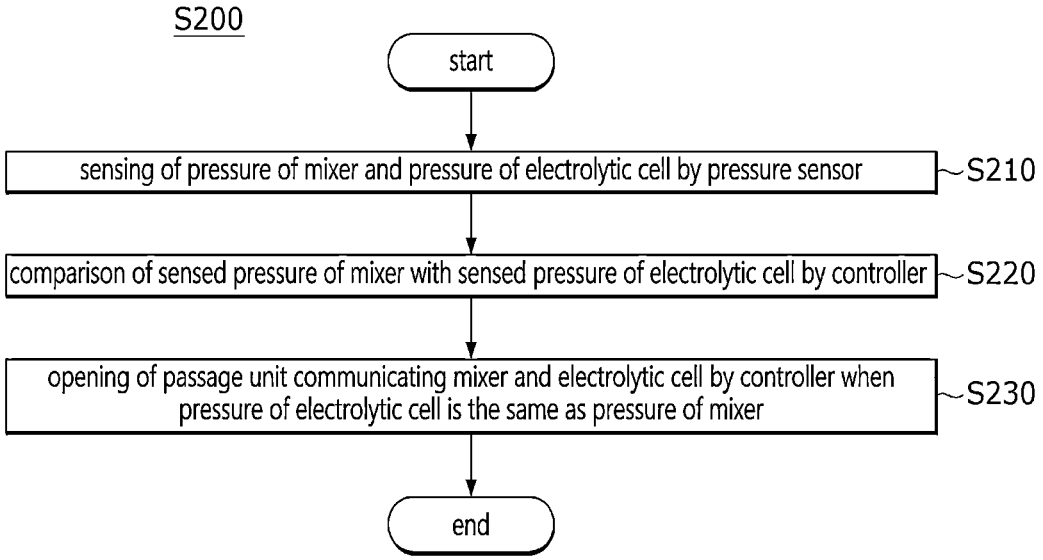
FIG. 10 is a flowchart illustrating a detailed flow of step S200 of the control method of the ammonia electrolysis system of FIG. 8.
Figure 11:
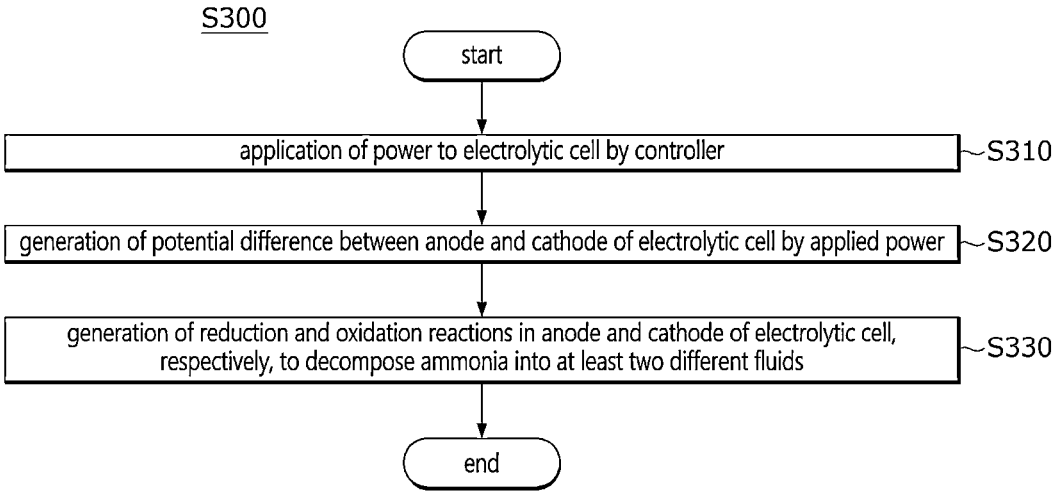
FIG. 11 is a flowchart illustrating a detailed flow of step S300 of the control method of the ammonia electrolysis system of FIG. 8.
Figure 12:
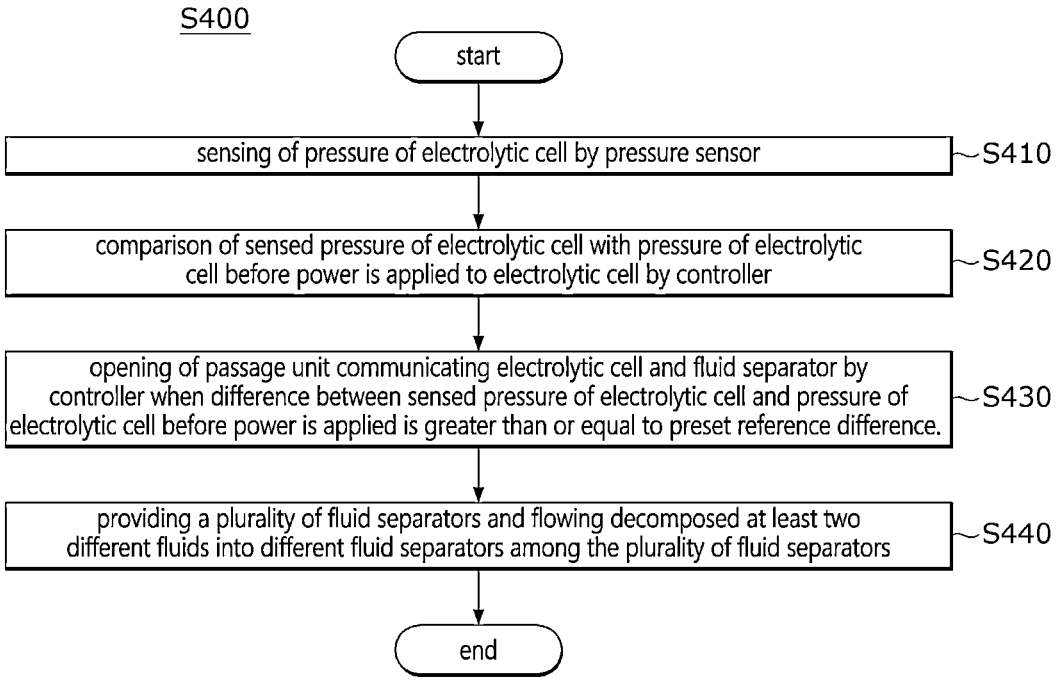
FIG. 12 is a flowchart illustrating a detailed flow of step S400 of the control method of the ammonia electrolysis system of FIG. 8.
Figure 13:
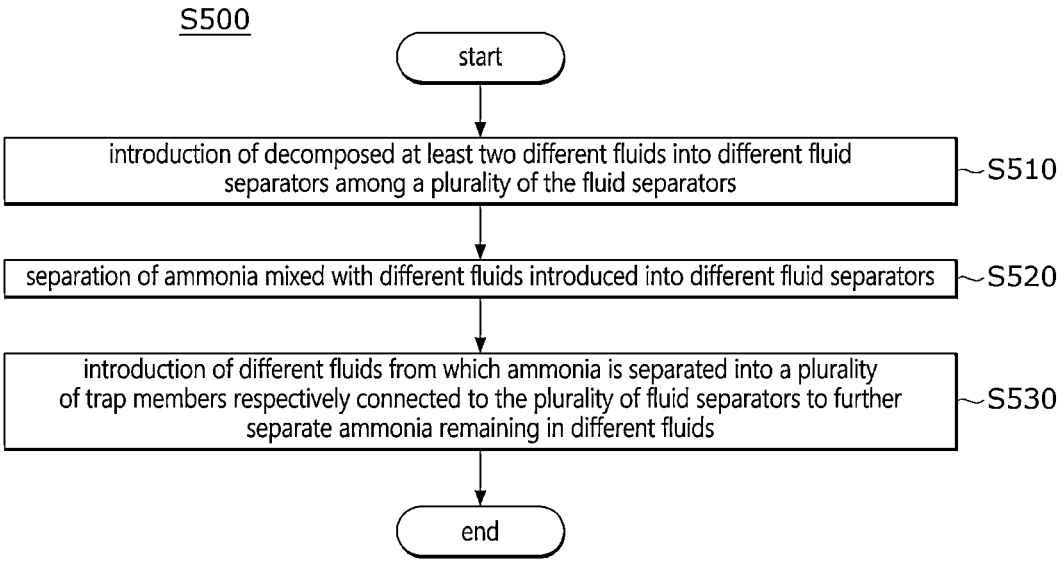
FIG. 13 is a flowchart illustrating a detailed flow of step S500 of the control method of the ammonia electrolysis system of FIG. 8.
Figure 14:
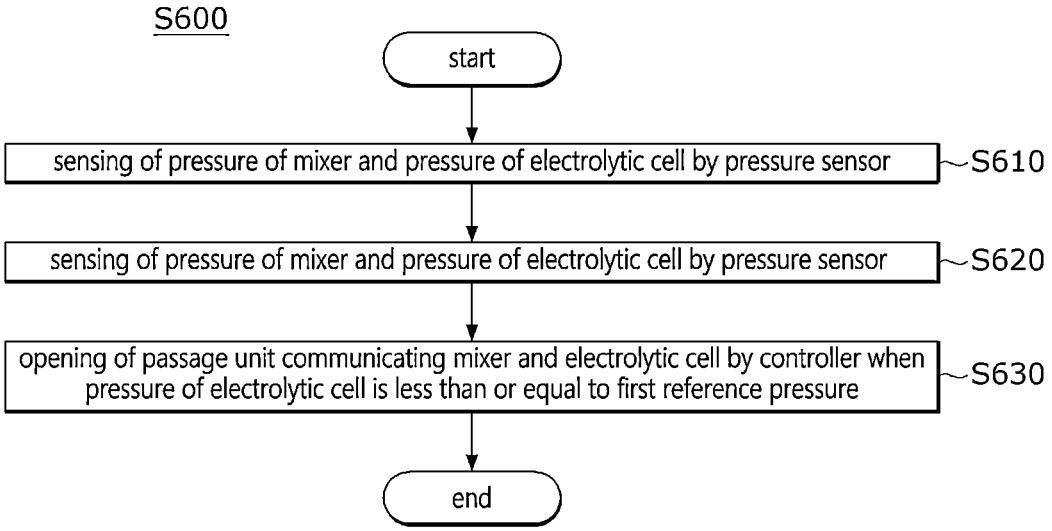
FIG. 14 is a flowchart illustrating a detailed flow of step S600 of the control method of the ammonia electrolysis system of FIG. 8.
Figure 15:
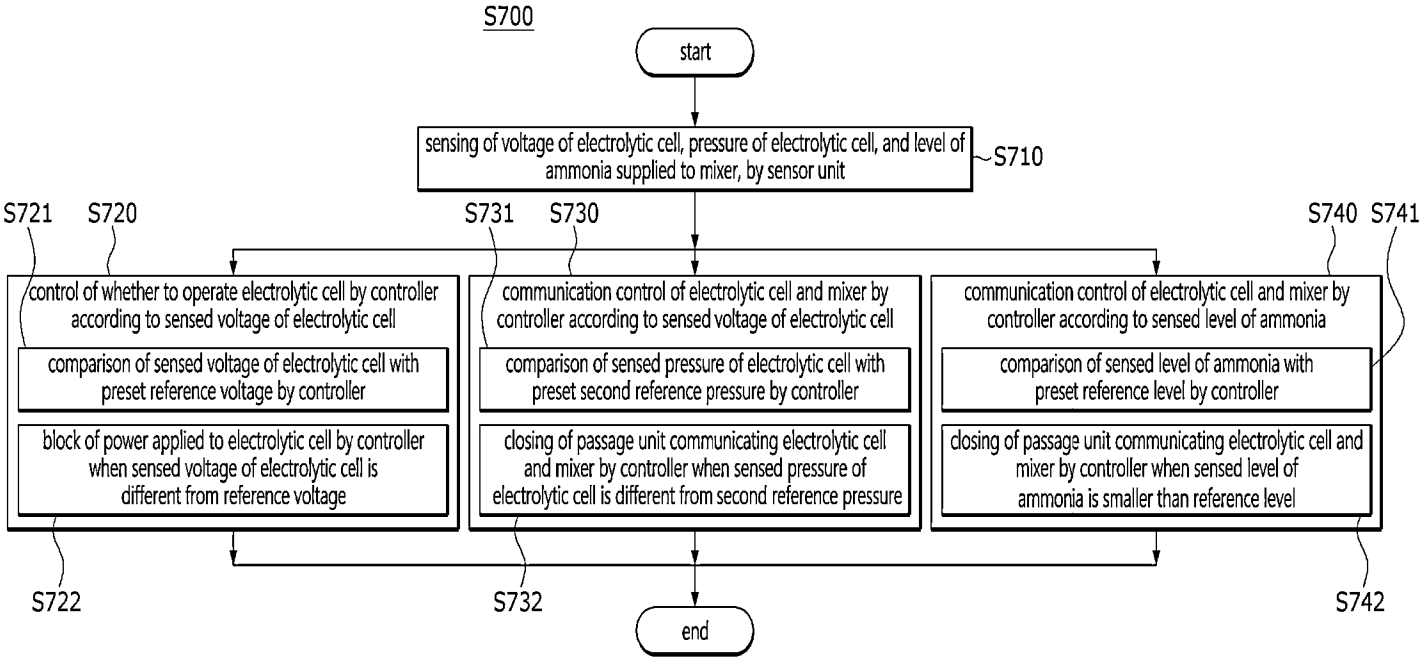
FIG. 15 is a flowchart showing a detailed flow of step S700 of the control method of the ammonia electrolysis system of FIG. 8.

Referring to FIG. 7, an ammonia electrolysis system 20 according to another embodiment of the present invention is illustrated.

When the ammonia electrolysis system 20 according to this embodiment is compared with the ammonia electrolysis system 10 according to the above-described embodiment, there is difference in the configuration that the ammonia separated in the fluid separator 300 is supplied back to the mixer 100 through the passage unit 510, rather than flowing out into a separate collection space (not shown).

To this end, the separated ammonia may be re-supplied to the mixer 100 through a separate return passage (not indicated by a reference numeral) provided in the passage unit 510. The return passage (not indicated by a reference numeral) may communicate the first fluid separator 300*a* and second fluid separator 300*b* constituting the fluid separator 300 with the mixer body 110, respectively.

In this case, the fluid flowing through the return passage (not indicated by a reference numeral) may include the additive previously supplied from the mixer 100 and electrolyzed hydrogen. In the case of electrolyzed nitrogen, in order to prevent the occurrence of a situation where it is synthesized externally as nitrogen oxide, it may be discharged to the outside after going through a separate denitrification process.

In addition, a power source such as a pump (not shown) may be provided so that the separated ammonia flows into the mixer body 110 through the return passage (not indicated by a reference numeral).

According to the ammonia electrolysis system 20 according to the present embodiment, the residual ammonia remaining after being separated into nitrogen and hydrogen through the electrolysis process, among the initially supplied ammonia, may be resupplied to the mixer 100, without the process of re-supplying after the separated ammonia is discharged.

Accordingly, a system for circulating ammonia can be configured, so that the occurrence of residual ammonia can be minimized. Accordingly, the configuration of the system can be simplified, and when the system is provided in a vehicle or the like by reducing the number of times of supply of additional ammonia, the effect can be maximized.

4. A Control Method of an Ammonia Electrolysis System 10 According to an Embodiment The control method of the ammonia electrolysis system 10 according to an embodiment of the present invention may be performed by organically operating each component of the ammonia electrolysis system 10 described above. By the control method, ammonia can be decomposed into nitrogen and hydrogen by an electrochemical method. Furthermore, the decomposed nitrogen and hydrogen may be moved to each fluid separator without a separate process for separating them, and discharged to the outside of the ammonia electrolysis system.

Hereinafter, a control method of the ammonia electrolysis system 10 according to an embodiment of the present invention will be described in detail with reference to FIGS. 8 to 15.

In the illustrated embodiment, the control method of the ammonia electrolysis system 10 includes the steps of controlling the temperature of the ammonia accommodated in the mixer 100 (S100), introducing the ammonia into the electrolytic cell 200 (S200), supplying power to the electrolytic cell 200 and separating the ammonia into at least two different fluids (S300), introducing the decomposed at least two different fluids into the fluid separator 300 (S400), further separating the at least two different fluids introduced into the fluid separator 300 (S500), further supplying ammonia from the mixer 100 to the electrolytic cell 200 (S600), and controlling the operations of the mixer 100 and electrolytic cell 200 by the controller 400 according to the states of the mixer 100 and electrolytic cell 200 (S700).

(1) Step of Controlling the Temperature of Ammonia Accommodated in the Mixer 100 (S100)

This step (S100) is the step (S100) in which ammonia is transferred to the mixer 100 from the bomber B or an external source and the temperature and components of the mixer 100 to which ammonia is transferred are controlled. Hereinafter, this step (S100) will be described in detail with reference to FIG. 9.

First, ammonia is supplied into the mixer 100 (S110). The ammonia may be transferred from the bombe B communicating with the external mixer body 110. To this end, the controller 400 may control a valve (not shown) provided to control the opening and closing of the inflow passage 511.

When ammonia is introduced into the inner space of the mixer body 110, the mixing temperature controller 140 controls the temperature of the introduced ammonia (S120). To this end, the mixing temperature controller 140 may control the temperature of the mixer body 110 in which ammonia is accommodated and the temperature of any component combined with the mixer body 110.

On the other hand, when the temperatures and pressures of the mixer body 110 and electrolytic cell 200 are identically formed as described above, the ammonia stored in the mixer body 110 may be transferred to the electrolytic cell 200.

The cell temperature controller 270 provided in the electrolytic cell 200 controls the temperature of the electrolytic cell 200 (S130). In this case, the cell temperature controller 270 may control the temperature of the electrolytic cell 200 to be the same as the temperatures of the mixer body 110 and ammonia accommodated in the mixer body 110.

To this end, the mixing temperature sensor 531*a* of the sensor unit 530 of the utility unit 500 provided adjacent to the mixer 100 may sense the temperature of the mixer body 110 in real time and continuously, and may transfer the sensed result to the controller 400.

In addition, an ionic additive is supplied to the inner space of the mixer body 110 through the additive supplier 130 formed in the mixer body 110 (S140). As the ionic additive is mixed, the reactivity of ammonia can be further increased.

The stirrer 120 that is provided in the mixer 100 and is rotatably coupled to the mixer body 110 is operated to mix ammonia and the supplied ionic additive (S150). Accordingly, the introduced ammonia and the ionic additive may be mixed evenly.

The order of the steps (S120, S130) of controlling the temperature of ammonia and the steps (S140, S150) of mixing the additive with ammonia may be changed. For example, as the additive is mixed with ammonia, the temperatures of the ammonia and mixer body 110 accommodating the ammonia may be finely changed. When the order of the above steps is changed, the temperature of ammonia or a mixed fluid of ammonia and additive may be more accurately adjusted.

The above steps may be performed automatically by the controller 400 or may be performed manually by an operator. However, considering that the ammonia electrolysis system 10 according to an embodiment of the present invention is miniaturized and modularized and may be provided in a vehicle, it is preferable that the above steps are automatically performed by the controller 400.

(2) Step of Introducing Ammonia into the Ammonia Electrolytic Cell 200 (S200)

This step (S200) is the step (S200) in which ammonia is introduced into the mixer 100 and the temperature of the ammonia is controlled, and the additive-mixed ammonia is introduced into the electrolytic cell 200 (S200). Hereinafter, this step (S200) will be described in detail with reference to FIG. 10.

First, the first pressure sensor 533*a* of the pressure sensor 533 provided in the sensor unit 530 of the utility unit 500 senses the internal pressure of the mixer body 110, and the second pressure sensor 533*b* and the third pressure sensor 533*c* sense the internal pressure of the electrolytic cell 200 (S210).

In this case, the inside of the mixer body 110 is a state in which ammonia or a mixed fluid of ammonia and an additive is accommodated. Accordingly, the internal pressure of the mixer body 110 sensed by the pressure sensor 533 may be the same as the pressure of ammonia or mixed fluid of ammonia and an additive.

The controller 400 receives the pressure of the inner space of the mixer body 110 and the pressure of the anode 220 and cathode 230 of the electrolytic cell 200 sensed by the pressure sensor 533, and compares the received pressures (S220). That is, the controller 400 determines whether the pressure in the inner space of the mixer body 110 is the same as the pressures of the anode 220 and cathode 230.

When the pressure of the electrolytic cell 200, that is, the pressures of the anode 220 and cathode 230 are the same as the pressure of the mixer body 110, the controller 400 controls the discharge valve 523 to open the supply passage 512 of the passage unit 510 communicating the mixer 100 and the electrolytic cell 200 (S230).

In this case, the controller 400 may also control the first supply passage 512*a* and the second supply passage 512*b* that are branched from the supply passage 512 and are in communication with the anode 220 and the cathode 230, respectively.

Accordingly, the supply passage 512 and the first supply passage 512*a* and second supply passage 512*b* branched from the supply passage 512 are opened, so that the mixer body 110 and the electrolytic cell 200 may communicate with each other.

In this case, the controller 400 may independently control the discharge valve 523, the first supply valve 524*a*, and the second supply valve 524*b*.

(3) Step of Supplying Power to the Electrolytic Cell 200 and Separating the Ammonia into at Least Two Different Fluids (S300)

This step (S300) is the step (S300) in which power is supplied to the electrolytic cell 200 into which ammonia is introduced, and the ammonia is electrolyzed into at least two different fluids. Hereinafter, this step (S300) will be described in detail with reference to FIG. 11.

First, the controller 400 applies power to the electrolytic cell 200 (S310). The power is utilized to electrolyze the ammonia supplied to the electrolytic cell 200 into at least two different fluids. To this end, the controller 400 and the electrolytic cell 200 are connected to be energized.

By the power applied to the electrolytic cell 200, a potential difference is generated between the anode 220 and cathode 230 of the electrolytic cell 200. In this case, the potential difference between the anode 220 and the cathode 230 may be determined as an arbitrary value between 0.1 V and 4 V.

As a potential difference is generated between the anode 220 and the cathode 230, the reaction according to Equation 1, that is, reduction and oxidation reactions, is generated in the anode 220 and the cathode 230, respectively. Accordingly, the ammonia introduced into the electrolytic cell 200 is electrolyzed into at least two different fluids (S330).

In one embodiment, the at least two different fluids may be nitrogen and hydrogen as described above.

(4) Step of Introducing the Decomposed at Least Two Different Fluids into the Fluid Separator 300 (S400)

This step (S400) is the step (S400) in which the at least two different fluids electrolyzed in the electrolytic cell 200 are flowed from the electrolytic cell 200 to the fluid separator 300. Accordingly, the at least two different fluids electrolyzed in the electrolytic cell 200 are discharged from the electrolytic cell 200, and ammonia is additionally supplied to the electrolytic cell 200 so that the electrolysis process can be further performed. Hereinafter, this step (S400) will be described in detail with reference to FIG. 12.

First, the pressure sensor 533 of the utility unit 500 senses the pressure of the electrolytic cell 200, and transmits the sensed pressure to the controller 400 (S410). Specifically, the second pressure sensor 533*b* senses the pressure of the anode 220, and the third pressure sensor 533*c* senses the pressure of the cathode 230, respectively, and transmits the sensed pressures to the controller 400.

The controller 400 compares the received pressure of the electrolytic cell 200 with the pressure of the electrolytic cell 200 that is before the power is applied and the electrolysis is started (S420). To this end, as described above, the pressure sensor 533 may sense the pressure of the electrolytic cell 200 in real time and continuously and transmit the sensed pressure to the controller 400.

This step (S420) is the step (S420) of comparing the pressure of the electrolytic cell 200 before ammonia is supplied to the electrolytic cell 200, the pressures of the electrolytic cell 200 after ammonia is supplied and before electrolysis proceeds, and the pressure of the electrolytic cell 200 after the supplied ammonia is electrolyzed to generate at least two different fluids.

Through this step (S420), the amount of electrolyzed ammonia or the amount of the at least two different fluids generated by electrolyzing ammonia may be inferred. That is, this step (S420) is the step of discharging the generated at least two different fluids from the electrolytic cell 200, and determining whether it is sufficient to introduce additional ammonia for performing additional electrolysis.

When the difference between the sensed pressure of the electrolytic cell 200 (i.e., the pressure after the electrolysis proceeds) and the pressure of the electrolytic cell 200 before power is applied to the electrolytic cell 200 (i.e., the pressure before the electrolysis proceeds after the ammonia is introduced) is greater than or equal to a preset reference difference, it may be determined that the previously supplied ammonia has been electrolyzed by a sufficient amount.

The controller 400 controls the mixing valve 525 of the valve unit 520 to open the mixing passage 513 communicating the electrolytic cell 200 and the fluid separator 300 (S430). In this case, the controller 400 may independently control the first mixing valve 525*a* and second mixing valve 525*b* of the mixing valve 525.

As described above, the fluid separator 300 may be provided in plurality and a plurality of the fluid separators 300 communicates with the electrolytic cell 200 by different mixing passages 513, respectively. The at least two different fluids generated by electrolysis of ammonia in the electrolytic cell 200 flow to different fluid separators 300 among the plurality of fluid separators 300, respectively (S440).

In an embodiment in which ammonia is electrolyzed into nitrogen and hydrogen, nitrogen may flow to the first fluid separator 300*a* and hydrogen may flow to the second fluid separator 300*b*, respectively.

Accordingly, the at least two different fluids electrolyzed in the electrolytic cell 200 may flow and be collected into different fluid separators 300, respectively, without going through a separate separation process.

(5) Step of Separating the Ammonia Accommodated in the at Least Two Different Fluids Introduced into the Fluid Separator 300 (S500)

This step (S500) is the step (S500) in which the ammonia mixed with the at least two different fluids introduced into the fluid separator 300 is further separated. Through this step (S500), the purity of the at least two fluids electrolyzed in ammonia may be increased. Hereinafter, this step (S500) will be described in detail with reference to FIG. 13.

After an ionic additive is mixed with ammonia in the mixer 100, the ionic additive moves to the electrolytic cell 200 and the fluid separator 300 as a mixture and may be separated in the separator body 310 of the fluid separator 300 by vaporizing the ammonia to induce the additive to be precipitated through the separation temperature controller 330.

First, the at least two different fluids electrolyzed from ammonia supplied to the electrolytic cell 200 are respectively introduced into different fluid separators 300 among the plurality of fluid separators 300 (S510).

In one embodiment, ammonia is separated into nitrogen and hydrogen, and may flow to the first fluid separator 300*a* and the second fluid separator 300*b*, respectively, as described above.

The different fluids introduced into the respective fluid separators 300*a*, 300*b* are separated from the ammonia mixed with the fluids through various treatment processes (S520). In one embodiment, the fluid separator 300 may separate the electrolyzed fluid and the ammonia mixed with the fluid through a method such as thermal separation, centrifugation, and density separation as described above.

Through this step (S520), the ammonia that has been mixed in each fluid (i.e., nitrogen and hydrogen in one embodiment) generated by electrolysis of ammonia may be separated. However, in the control method of the ammonia electrolysis system 10 according to an embodiment of the present invention, an additional separation process is performed through the trap member 320 to separate the ammonia contained in each generated fluid completely.

Specifically, the different fluids from which ammonia is separated in the fluid separator 300 flow to different trap members 320 in communication with the respective fluid separators 300, and the residual ammonia mixed with the fluids is further separated (S530).

In this case, the trap member 320 is provided in plurality connected to each other, so that an additional separation process of ammonia may be performed more efficiently. That is, again referring to FIG. 6, the different fluids from which ammonia is primarily separated in the fluid separator 300 pass through the first trap member 320*a* and the second trap member 320*b*, respectively, and the residual ammonia mixed with the fluids is additionally separated Accordingly, the different fluids that have passed through the trap member 320 may be directly introduced into a subsequent process. In one embodiment in which different fluids are generated as nitrogen and hydrogen, the nitrogen may be directly introduced into a device for performing a denitrification process, and the hydrogen may be transferred to a device operated using hydrogen as a fuel, such as a fuel cell.

On the other hand, the ammonia remaining after the electrolysis through this step (S500) may be directly re-supplied to the bomber B or the mixer 100, and may be supplied to the electrolytic cell 200 again after a necessary treatment process.

(6) Step of Further Supplying Ammonia from the Mixer 100 to the Electrolytic Cell 200 (S600)

This step (S600) is the step (S600) in which the ammonia separated from the fluid generated through the above-described steps (S100 to S500) and additional ammonia are further supplied to the mixer 100 in order to further perform the electrolysis process of ammonia. Hereinafter, this step (S600) will be described in detail with reference to FIG. 14.

First, the pressure sensor 533 provided in the sensor unit 530 of the utility unit 500 senses the pressure of the mixer body 110 and the pressure of the electrolytic cell 200 (S610). It will be understood that this step (S610) is the step (S610) for identifying whether fluids, that is, ammonia and different fluids generated by the electrolysis of the ammonia, remain in the mixture body 110 or the electrolytic cell 200.

As described above, the first pressure sensor 533*a* senses the pressure of the mixer body 110, the second pressure sensor 533*b* senses the pressure of the anode 220 of the electrolytic cell 200, the third pressure sensor 533*c* senses the pressure of the cathode 230 of the electrolytic cell 200. Each of the sensed pressures is transmitted to the controller 400.

The controller 400 compares the sensed pressure of the mixer body 110 with the pressure of the electrolytic cell 200, specifically, the pressures of the anode 220 and cathode 230 (S620). As described above, when the pressure of the mixer body 110 and the pressure of the electrolytic cell 200 are the same, due to this, preferably ammonia is supplied to the electrolytic cell 200.

When the pressure of the mixer body 110 and the pressure of the electrolytic cell 200 are the same and the pressure of the electrolytic cell 200 is less than or equal to a preset first reference pressure, the controller 400 controls the discharge valve 523 and supply valve 524 of the valve unit 520 to communicate the mixer body 110 and the electrolytic cell 200 (S630).

In this case, the preset first reference pressure may be determined as an arbitrary value to which ammonia must be additionally supplied in order to further perform the electrolysis process of ammonia in the electrolytic cell 200.

By this step (S630), ammonia is additionally supplied to the electrolytic cell 200, the electrolysis process of ammonia may be further proceeded. As a result, at least two different fluids may be additionally generated in the electrolytic cell 200.

(7) Step of Controlling the Operations of the Mixer 100 and Electrolytic Cell 200 by the Controller 400 According to the States of the Mixer 100 and Electrolytic Cell 200 (S700)

This step (S700) is the step (S700) in which the controller 400 senses whether each component of the ammonia electrolysis system 10 in operation is damaged and the amount of ammonia, and controls whether the ammonia electrolysis system 10 operates according to the result. Hereinafter, this step (S700) will be described in detail with reference to FIG. 15.

The sensor unit 530 provided in the utility unit 500 senses information about the state of each component of the ammonia electrolysis system 10 (S710).

Specifically, the voltage sensor 535 of the sensor unit 530 senses the voltage of the electrolytic cell 200, that is, a potential difference between the anode 220 and the cathode 230. In addition, the second pressure sensor 533*b* and third pressure sensor 533*c* of the pressure sensor 533 sense the pressure of the anode 220 and cathode 230 of the electrolytic cell 200. Furthermore, the level sensor 534 senses the level of ammonia contained in the mixer body 110. Each information sensed by each of the sensors 533, 534, and 535 is transmitted to the controller 400.

The controller 400 may determine whether the ammonia electrolysis system 10 is abnormal according to each sensed information.

First, the step (S720) of sensing whether the electrolytic cell 200 operates according to the sensed voltage of the electrolytic cell 200 by the controller 400 will be described. This step (S720) is the step (S720) of identifying whether there is abnormality by the controller 400 and controlling the operation of the ammonia electrolysis system 10 according to the result.

The controller 400 compares the sensed voltage of the electrolytic cell 200 with a preset reference voltage (S721). In this case, the preset reference voltage may be set to an arbitrary value that may determine that the anode 220 or cathode 230 provided in the electrolytic cell 200 is normally operated. In one embodiment, the reference voltage may be determined in a range of 0.1 V to 5 V.

When the sensed voltage of the electrolytic cell 200 is different from the reference voltage, the controller 400 stops the operation of the electrolytic cell 200 by cutting off the power applied to the electrolytic cell 200 (S722). In one embodiment in which the reference voltage is set to a range, when the sensed voltage of the electrolytic cell 200 is out of the range of the reference voltage, the controller 400 may perform the step (S722).

Next, the step (S730) of sensing by the controller 400 whether the electrolytic cell 200 operates according to the sensed pressure of the electrolytic cell 200 will be described. This step (S730) is the step (S730) of identifying the progress of the electrolysis process of ammonia, and controlling the operation of the ammonia electrolysis system 10 according to the result.

The controller 400 compares the sensed pressure of the electrolytic cell 200 with a preset second reference pressure (S731). In this case, the preset second reference pressure may be determined as a minimum value of the pressure when the amount of ammonia to be electrolyzed in the electrolytic cell 200 is sufficient or a minimum value of the pressure required to maintain the ammonia in a predetermined phase. In an embodiment, the second reference pressure may be set to 7 bar.

When the sensed pressure of the electrolytic cell 200 is greater than the second reference pressure, at least two different fluids are excessively generated inside the electrolytic cell 200, so that a problem in durability and safety of the electrolytic cell 200 may occur.

In addition, when the sensed pressure of the electrolytic cell 200 is less than the second reference pressure, the component of the electrolytic cell 200, for example, the anode 220 or the cathode 230 is damaged, so that it may determine that the electrolytic reaction does not sufficiently proceed.

The controller 400 closes the supply passage 512 communicating the electrolytic cell 200 and the mixer 100 and the first mixing passage 513*a* and second mixing passage 513*b* branched from the supply passage 512 to block the communication between the electrolytic cell 200 and the mixer 100 (S732).

To this end, as described above, the controller 400 may control the discharge valve 523 and the supply valve 524, that is, the first supply valve 524*a* and the second supply valve 524*b*.

Next, the step (S740) of controlling the communication between the electrolytic cell 200 and the mixer 100 by the controller 400 according to the sensed level of ammonia will be described. This step (S740) is also the step (S740) of identifying the progress of the electrolysis process of ammonia, and controlling the operation of the ammonia electrolysis system 10 according to the result.

The controller 400 compares the sensed level of ammonia, that is, the level of ammonia accommodated in the mixer body 110, with a preset reference level (S741). In this case, the preset reference level may be determined as a level of ammonia sufficient to supply ammonia to the electrolytic cell 200.

That is, when an amount of ammonia smaller than the reference level is accommodated in the mixer body 110, it may be understood that the mixer body 110 needs to additionally receive ammonia from the bomber B. In addition, when an amount of ammonia greater than the reference level is accommodated in the mixer body 110, it may be understood that the ammonia accommodated in the mixer body 110 may be further supplied to the electrolytic cell 200.

When the sensed level of ammonia is smaller than the reference level, the controller 400 closes the supply passage 512 communicating the electrolytic cell 200 and the mixer 100 and the first mixing passage 513*a* and second mixing passage 513*b* branched from the supply passage 512 to block the communication between the electrolytic cell 200 and the mixer 100 (S742).

Hereinafter, an ammonia electrolysis system, a control method of the ammonia electrolysis system, an electrolytic cell, and a fluid separator according to an embodiment of the present invention will be described.

An ammonia electrolysis system according to an embodiment includes a mixer to which ammonia is supplied: an electrolytic cell that is in communication with the mixer and is configured to receive the supplied ammonia and electrolyze the supplied ammonia into at least two different fluids; and a fluid separator that communicates with the electrolytic cell, receives the electrolyzed at least two different fluids, and separates the ammonia contained in the at least two different fluids.

The fluid separator may be provided in plurality, and the at least two different fluids may be respectively transferred to each of the plurality of fluid separators.

The electrolytic cell electrolyzes the ammonia into hydrogen ($H_2$) and nitrogen ($N_2$), and the decomposed hydrogen and nitrogen may be introduced into each of the plurality of fluid separators, respectively.

The electrolytic cell may include an anode and cathode placed apart from each other, and a membrane member disposed between the anode and the cathode to space the anode and the cathode apart.

The mixer may include a mixer body that has a space accommodating the ammonia therein: an additive supplier that communicates the space and an outside, and through which an additive to be mixed with the ammonia is introduced; and a stirrer that is rotatably accommodated in the space of the mixer body and mixes the supplied ammonia with the introduced additive.

The ammonia electrolysis system may include a controller that is electrically connected to the electrolytic cell and is configured to supply power for the electrolytic cell to electrolyze the ammonia into the at least two different fluids.

The mixer may include a mixing temperature controller that is configured to control the temperature of the ammonia contained in the mixer, and the electrolytic cell may include a cell temperature controller that is configured to control the temperature of an inner space of the electrolytic cell.

The ammonia electrolysis system may include a pressure sensor that senses the pressure of the mixer to which the ammonia is supplied and the pressure of the electrolytic cell: and a controller that is configured to communicate the mixer and the electrolytic cell so that the supplied ammonia flows to the electrolytic cell when the sensed pressure of the mixer and the sensed pressure of the electrolytic cell are the same.

In the ammonia electrolysis system, the ammonia may be in a liquid phase or a gas phase.

A method of controlling an ammonia electrolysis system according to an embodiment includes the steps of (a) controlling the temperature of ammonia accommodated in a mixer: (b) introducing the ammonia into an electrolytic cell: (c) supplying power to the electrolytic cell to electrolyze the ammonia into at least two different fluids: (d) introducing the decomposed at least two different fluids into a fluid separator: and (e) separating the ammonia contained in the at least two different fluids introduced into the fluid separator.

The step (a) may include the steps of (a1) supplying the ammonia into the mixer: (a2) controlling the temperature of the mixer accommodating the ammonia by a mixing temperature controller: and (a3) controlling the temperature of the electrolytic cell by a cell temperature controller.

The step (a) may include the steps of (a4) introducing an additive into the mixer; and (a5) operating a stirrer provided in the mixer to mix the ammonia and the additive.

The step (b) may include the steps of (b1) sensing the pressure of the mixer and the pressure of the electrolytic cell by a pressure sensor: (b2) comparing the sensed pressure of the mixer with the sensed pressure of the electrolytic cell by a controller; and (b3) opening a passage unit communicating the mixer and the electrolytic cell by the controller when the pressure of the electrolytic cell is the same as the pressure of the mixer.

The step (c) may include the steps of (c1) applying power to the electrolytic cell by a controller: (c2) generating a potential difference between the anode and cathode of the electrolytic cell by the applied power: and (c3) generating reduction and oxidation reactions in the cathode and anode of the electrolytic cell, respectively, to decompose the ammonia into the at least two different fluids.

The (d) step may include the steps of (d1) sensing the pressure of the electrolytic cell by a pressure sensor: (d2) comparing the pressure of the electrolytic cell sensed by a controller with the pressure of the electrolytic cell before the power is supplied to the electrolytic cell: and (d3) opening a passage unit communicating the electrolytic cell and the fluid separator by the controller when the difference between the sensed pressure of the electrolytic cell and the pressure of the electrolytic cell before the power is applied is greater than or equal to a preset reference difference. The fluid separator may be provided in plurality, and the at least two different fluids may be configured to flow to different fluid separators among the plurality of fluid separators.

The step (e) may include the steps of (e1) introducing the decomposed at least two different fluids into different fluid separators among a plurality of the fluid separators: (e2) separating ammonia mixed with the different fluids introduced into the different fluid separators; and (e3) introducing the different fluids from which the ammonia is separated into a plurality of trap members respectively connected to the plurality of fluid separators to further separate the ammonia remaining in the different fluids.

After the step (e), the step (f) of further supplying the ammonia from the mixer to the electrolytic cell may be further included.

The step (f) may include the steps of (f1) sensing the pressure of the mixer and the pressure of the electrolytic cell by a pressure sensor: (f2) comparing the pressure of the mixer sensed by a controller with the pressure of the electrolytic cell: and (f3) opening a passage unit communicating the mixer and the electrolytic cell by the controller when the pressure of the electrolytic cell is less than or equal to a preset first reference pressure.

A method of controlling an ammonia electrolysis system of items 9 to 18 may be provided by including, after the step (e), the step (g) of controlling the operations of the mixer and electrolytic cell according to the states of the mixer and electrolytic cell by a controller.

The step (g) may include the steps of (g1) sensing the voltage of the electrolytic cell, the pressure of the electrolytic cell, and the level of the ammonia supplied to the mixer, by a sensor unit: (g21) comparing the sensed voltage of the electrolytic cell with a preset reference voltage by the controller: (g22) blocking the power applied to the electrolytic cell by the controller when the sensed voltage of the electrolytic cell is different from the reference voltage: (g31) comparing the sensed pressure of the electrolytic cell with a preset second reference pressure by the controller; (g32) closing the passage unit communicating the electrolytic cell and the mixer by the controller when the sensed pressure of the electrolytic cell is different from the second reference pressure: (g41) comparing the sensed level of ammonia with a preset reference level by the controller; and (g42) closing the passage unit communicating the electrolytic cell and the mixer by the controller when the sensed level of ammonia is smaller than the reference level.

In addition, an electrolytic cell according to an embodiment may include an electrolytic cell housing that is formed with a space for accommodating the ammonia transferred from an external mixer; an anode and cathode accommodated in the space of the electrolytic cell housing: and a membrane member that is positioned between the anode and the cathode to space the anode and the cathode apart. The anode and the cathode may be configured to be electrically connected to an external controller, respectively, and electrolyze the accommodated ammonia into at least two different fluids by using a current transmitted from the controller.

The membrane member may be formed of an ionomer material that blocks the ions generated from any one of the anode and the cathode from moving to the other one of the anode and the cathode.

The membrane member may be formed of a ceramic material that allows only molecules of a predetermined size or less to pass therethrough.

The electrolytic cell housing may include a first cell housing that has a space accommodating any one of the anode and the cathode; and a second cell housing that has a space accommodating the other one of the anode and the cathode and is coupled to the first cell housing.

The first cell housing and the second cell housing may be configured to communicate with the external mixer through a separate flow path, respectively.

The electrolytic cell housing may be configured to communicate with an external fluid separator receiving the at least two different fluids.

The electrolytic cell is provided with a plurality of external fluid separators, and the electrolytic cell housing may include a first cell housing that is formed with a space accommodating any one of the anode and the cathode and communicating with any one of the plurality of external fluid separators; and a second cell housing that is formed with a space accommodating the other one of the anode and the cathode, communicating with the other one of the plurality of external fluid separators, and being physically separated from the space of the first cell housing.

The electrolytic cell may include a gasket member that is disposed between the anode and the cathode and is formed to surround the outer periphery of the membrane member.

An ammonia electrolysis system according to an embodiment may include a mixer to which ammonia is supplied: an electrolytic cell that is in communication with the mixer, is configured to receive the supplied ammonia and electrolyze the received ammonia into at least two different fluids: and a fluid separator that communicates with the electrolytic cell and receives the electrolyzed at least two different fluids to separate the ammonia contained in the at least two different fluids. The electrolytic cell includes an electrolytic cell housing that communicates with the mixer and has a space to receive and accommodate the ammonia: an anode and cathode that are accommodated in the space of the electrolytic cell housing and are electrically connected to an external controller to electrolyze the accommodated ammonia: and a membrane member that is positioned between the anode and the cathode to space the anode and the cathode apart. The membrane member may be made of an ionomer material that blocks the ions generated from one of the anode and the cathode from moving to the other one of the anode and the cathode.

A fluid separator according to an embodiment includes a separator body that receives at least two different fluids generated by electrolysis of ammonia in an external electrolytic cell, and separates the ammonia contained in the at least two different fluids; and a trap member that communicates with the separator body to receive the at least two different fluids from which the ammonia is separated. The separator body is provided in plurality, and the plurality of the separator bodies may be configured to receive different fluids among the at least two different fluids.

In the fluid separator, the external electrolytic cell includes a plurality of spaces that accommodates the at least two different fluids, respectively, and is separated from each other, and the plurality of the separator bodies may be configured to communicate with the plurality of the spaces provided in the external electrolytic cell, respectively, and to receive the generated at least two different fluids, respectively.

The fluid separator may include a separation temperature controller that is configured to be connected to the separator body and to control the temperatures of the separator body and at least two different fluids accommodated in the separator body.

The separator body is provided in plurality, and a plurality of the separator bodies receives and accommodates the generated at least two different fluids, respectively, and the separation temperature controller may be provided in plurality, and a plurality of the separation temperature controllers may be connected to the plurality of separator bodies, respectively.

The trap member may be configured to further separate the residual ammonia from the received at least two different fluids.

The trap member may be provided in plurality, so that any one of a plurality of the trap members may be configured to communicate with the separator body, and the other one of the plurality of trap members may be configured to communicate with the one trap member and the outside.

The generated at least two different fluids may pass sequentially through the separator body and the plurality of trap members to be separated from the residual ammonia.

An ammonia electrolysis system according to an embodiment includes a mixer to which ammonia is supplied: an electrolytic cell that is configured to be in communication with the mixer and to receive the supplied ammonia and electrolyze the received ammonia into at least two different fluids; and a fluid separator that communicates with the electrolytic cell and receives the electrolyzed at least two different fluids to separate the ammonia contained in the at least two different fluids. The fluid separator includes a separator body that communicates with the electrolytic cell and receives the at least two different fluids to separate the ammonia mixed with the fluids; and a trap member that communicates with the separator body and receives the at least two different fluids from which the ammonia is separated and further separates the residual ammonia. The separator body is provided in plurality, and a plurality of the separator bodies receives different fluids from among the at least two different fluids. The trap member is provided in plurality. The at least two different fluids passing through the separator body sequentially pass through the plurality of trap members and the residual ammonia may be separated.

The method of controlling the ammonia electrolysis system 10 described above may be automatically performed by the controller 400. The controller 400 may calculate control information for calculating each component of the ammonia electrolysis system 10 using various sensed factors (temperature, pressure, voltage, level, etc.), and control each component according to the calculated control information.

Although the above has been described with reference to the preferred embodiment of the present invention, those of ordinary skill in the art will understand that various modifications and changes can be made to the present invention without departing from the spirit and scope of the present invention as set forth in the claims below.

DESCRIPTION OF REFERENCE NUMERALS

10: ammonia electrolysis system
100: mixer

110: mixer body
120: stirrer
130: additive supplier
140: mixing temperature controller
150: transfer device
200: electrolytic cell (cell)
210: electrolytic cell housing
211: first cell housing
212: second cell housing
220: anode
230: cathode
240: membrane member
250: diffusion member
251: first diffusion member
252: second diffusion member
260: gasket member
270: cell temperature controller
300: fluid separator
300*a*: first fluid separator
300*b*: second fluid separator
310: separator body
311: inlet
312: outlet
320: trap member
320*a*: first trap member
320*b*: second trap member
330: separation temperature controller
331: first separation temperature controller
332: second separation temperature controller
400: controller
500: utility unit
510: passage unit
511: inflow passage
512: supply passage
512*a*: first supply passage
512*b*: second supply passage
513: mixing passage
513*a*: first mixing passage
513*b*: second mixing passage
514: discharge passage
514*a*: first discharge passage
514*b*: second discharge passage
520: valve unit
521: pressure control valve
522: gas supply valve
523: communication valve
524: supply valve
524*a*: first supply valve
524*b*: second supply valve
525: mixing valve
525*a*: first mixing valve
525*b*: second mixing valve
526: discharge valve
526*a*: first discharge valve
526*b*: second discharge valve
530: sensor unit
531: temperature sensor
531*a*: mixing temperature sensor
531*b*: cell temperature sensor
532: flow sensor
532*a*: first flow sensor
532*b*: second flow sensor
533: pressure sensor
533*a*: first pressure sensor
533*b*: second pressure sensor
533*c*: third pressure sensor
534: level sensor
535: voltage sensor
B: bombe

The invention claimed is:

1. An ammonia electrolysis system, comprising:

a mixer to which ammonia is supplied;

an electrolytic cell that is in communication with the mixer and is configured to receive the supplied ammonia and electrolyze the supplied ammonia into at least two different fluids;

a fluid separator that communicates with the electrolytic cell, receives the electrolyzed at least two different fluids, and separates the ammonia contained in the at least two different fluids;

a pressure sensor that senses a pressure of the mixer to which the ammonia is supplied and a pressure of the electrolytic cell; and a controller that is connected in communication with the pressure sensor and that controls a flow of ammonia responsive to the sensed pressure of the mixer and the sensed pressure of the electrolytic cell communicated from the pressure sensor, the controller being configured to communicate with the mixer and the electrolytic cell so that the supplied ammonia flows to the electrolytic cell when the sensed pressure of the mixer and the sensed pressure of the electrolytic cell are the same, wherein the at least two different fluids are hydrogen ($H_2$) and nitrogen ($N_2$)

wherein the electrolytic cell includes a first cell housing having an anode therein and a second cell housing having a cathode therein;

wherein the first cell housing and the second cell housing being separated from each other with a membrane member disposed between the first cell housing and the second cell housing to space the anode and the cathode apart, wherein the pressure sensor includes a first pressure sensor to sense the pressure of the mixer, a second pressure sensor to sense a pressure of an inner space of the first cell housing, and a third pressure sensor to sense a pressure of an inner space of the second cell housing, and wherein the controller controls the flow of ammonia responsive to the sensed pressures of the first, second, and third pressure sensors so that the supplied ammonia flows to the electrolytic cell when the sensed pressure of the mixer, the sensed pressure of the inner space of the first cell housing, and the sensed pressure of the inner space of the second cell housing are the same.

2. The ammonia electrolysis system according to claim 1, wherein the fluid separator is provided in plurality, and the at least two different fluids are respectively transferred to each of a plurality of the fluid separators.

3. The ammonia electrolysis system according to claim 2, wherein the electrolytic cell electrolyzes the ammonia into hydrogen ($H_2$) and nitrogen ($N_2$), and the decomposed hydrogen and nitrogen are respectively introduced into each of the plurality of fluid separators.

4. The ammonia electrolysis system according to claim 1, wherein the mixer includes:

a mixer body that is formed with a space accommodating the ammonia therein;

an additive supplier that communicates the space and an outside, and through which an additive to be mixed with the ammonia is introduced; and a stirrer that is rotatably accommodated in the space of the mixer body and mixes the supplied ammonia with the introduced additive.

5. The ammonia electrolysis system according to claim 1, comprising a controller that is electrically connected to the electrolytic cell and is configured to supply power for the electrolytic cell to electrolyze the ammonia into the at least two different fluids.

6. The ammonia electrolysis system according to claim 1, wherein the mixer includes a mixing temperature controller that is configured to control temperature of the ammonia accommodated in the mixer, and the electrolytic cell includes a cell temperature controller that is configured to control temperature of an inner space of the electrolytic cell.

7. The ammonia electrolysis system according to claim 1, wherein the ammonia is in a liquid phase or a gas phase.

* * * * *